US012698174B2

(12) United States Patent
Yang et al.

(10) Patent No.: US 12,698,174 B2
(45) Date of Patent: Aug. 4, 2026

(54) AUTOMATIC ROLL-REPLACING APPARATUS

(71) Applicant: Wuxi Lead Intelligent Equipment Co., Ltd., Wuxi (CN)

(72) Inventors: Xiaofei Yang, Wuxi (CN); Er Cao, Wuxi (CN)

(73) Assignee: Wuxi Intelligent Equipment Co., Ltd., Wuxi (CN)

( * ) Notice: Subject to any disclaimer, the term of this patent is extended or adjusted under 35 U.S.C. 154(b) by 422 days.

(21) Appl. No.: 18/233,504

(22) Filed: Aug. 14, 2023

(65) Prior Publication Data

US 2024/0002184 A1 Jan. 4, 2024

Related U.S. Application Data

(63) Continuation of application No. PCT/CN2022/135488, filed on Nov. 30, 2022.

(30) Foreign Application Priority Data

Jul. 1, 2022 (CN) ..... 202210773819.6
Nov. 2, 2022 (CN) ..... 202222914721.6

(51) Int. Cl.
*B65H 19/12* (2006.01)
*B65H 19/10* (2006.01)
(Continued)

(52) U.S. Cl.
CPC ..... *B65H 19/12* (2013.01); *B65H 19/102* (2013.01); *B65H 19/123* (2013.01);
(Continued)

(58) Field of Classification Search
CPC ..... B65H 19/10; B65H 19/102; B65H 19/12; B65H 19/123; B65H 19/1842;
(Continued)

(56) References Cited

U.S. PATENT DOCUMENTS 3,440,126 A * 4/1969 Robinson ..... B65H 19/1868 242/551
3,780,960 A * 12/1973 Tokuno ..... B65H 19/1836 242/555.2
(Continued)

FOREIGN PATENT DOCUMENTS

CN 115258766 A 11/2022
CN 218319742 U 1/2023
(Continued)

*Primary Examiner* — Emmanuel M Marcelo
*Assistant Examiner* — Raveen J Dias
(74) *Attorney, Agent, or Firm* — Baker Botts LLP

(57) ABSTRACT

The present disclosure relates to an automatic roll-replacing apparatus, including: an unwinding device, a starting-end-handling device comprising a support mechanism and a pick-up mechanism, the support mechanism is located between the standby material roll and the working material roll; the pick-up mechanism is configured to pick up a material strip starting end of a standby material strip and pull the material strip starting end to reach a location between the support mechanism and the working material roll; and a strip-connecting device including two strip-connecting mechanisms that either carries a tape.

20 Claims, 19 Drawing Sheets

(51) Int. Cl.
*B65H 19/18* (2006.01)
*B65H 19/20* (2006.01)

(52) U.S. Cl.
CPC ..... *B65H 19/1842* (2013.01); *B65H 19/1852* (2013.01); *B65H 19/20* (2013.01); *B65H 2301/4172* (2013.01); *B65H 2301/4176* (2013.01); *B65H 2301/41764* (2013.01); *B65H 2301/418* (2013.01); *B65H 2301/4606* (2013.01); *B65H 2301/4607* (2013.01); *B65H 2301/4611* (2013.01); *B65H 2301/46115* (2013.01); *B65H 2301/46172* (2013.01); *B65H 2301/462* (2013.01); *B65H 2301/4622* (2013.01); *B65H 2301/463* (2013.01); *B65H 2301/4631* (2013.01); *B65H 2405/58* (2013.01); *B65H 2406/34* (2013.01)

(58) Field of Classification Search
CPC .... B65H 19/1852; B65H 19/20; B65H 20/16; B65H 20/18; B65H 19/1857; B65H 19/1863; B65H 19/1873; B65H 19/1805; B65H 19/1826; B65H 19/1831; B65H 19/1836; B65H 2301/417; B65H 2301/4176; B65H 2301/41764; B65H 2301/41766; B65H 2301/4606; B65H 2301/4607; B65H 2301/46075; B65H 2301/46078; B65H 2301/461; B65H 2301/4611; B65H 2301/46115; B65H 2301/4615; B65H 2301/46172; B65H 2301/418; B65H 2301/4182; B65H 2301/4185; B65H 2301/41856; B65H 2301/41858; B65H 2301/462; B65H 2301/4621; B65H 2301/4622; B65H 2301/463; B65H 2301/4631; B65H 2301/46312; B65H 2301/46314; B65H 2405/58; B65H 2405/5812; B65H 2406/30; B65H 2406/31; B65H 2406/32; B65H 2406/33; B65H 2406/331; B65H 2406/34; B65H 2406/341; B65H 2406/345
See application file for complete search history.

(56) References Cited

U.S. PATENT DOCUMENTS 3,858,819 A * 1/1975 Butler, Jr. ..... B65H 19/1852 242/556.1
3,939,032 A * 2/1976 Taitel ..... B65H 21/00 156/518
3,995,791 A * 12/1976 Schoppee ..... B65H 19/1873 53/64
4,010,911 A * 3/1977 Heitmann ..... B65H 19/1852 242/556.1
4,190,483 A * 2/1980 Ryan ..... B65H 19/20 242/552
4,331,301 A * 5/1982 Martinez ..... B65H 19/1873 242/556.1
4,450,039 A * 5/1984 Salvucci ..... B65H 19/1852 225/36
4,481,053 A * 11/1984 Tokuno ..... B65H 19/1852 156/159
4,668,328 A * 5/1987 Kyytsoenen ..... B65H 19/1878 156/159
4,722,489 A * 2/1988 Wommer ..... B65H 19/1852 242/556.1
4,801,342 A * 1/1989 Wheeler ..... B65H 19/1873 156/304.3
4,984,750 A * 1/1991 Shigeta ..... B65H 19/29 242/562.1
5,018,535 A * 5/1991 Da Silva ..... A24C 5/20 131/105
5,285,978 A * 2/1994 Sakano ..... B65H 19/123 242/562
5,316,229 A * 5/1994 Draghetti ..... B65H 19/1868 242/555.2
5,381,983 A * 1/1995 Sakano ..... B65H 19/123 242/562.1
5,411,223 A * 5/1995 Gatteschi ..... B65H 19/1852 242/554.2
5,730,389 A * 3/1998 Biagiotti ..... B65H 19/1863 242/556.1
5,735,987 A * 4/1998 Boriani ..... B65B 61/182 131/105
5,881,964 A * 3/1999 Fujikura ..... B65H 35/0013 242/562.1
6,051,095 A * 4/2000 Butterworth ..... B65H 19/1873 156/286
6,451,145 B1 * 9/2002 Forbes ..... B65H 19/1836 156/507
6,565,034 B1 * 5/2003 Hesse ..... B65H 19/1847 242/556.1
6,786,264 B1 * 9/2004 Torres Martinez ..... B65H 19/1873 156/507
6,881,289 B2 * 4/2005 Borderi ..... B65H 19/1836 156/159
6,923,880 B2 * 8/2005 Keene ..... B65H 23/1886 156/159
7,516,916 B2 * 4/2009 Titz ..... B65H 19/102 242/555.6
8,951,179 B2 * 2/2015 Tommasi ..... B65H 19/1836 493/203
2001/0016120 A1 * 8/2001 Hara ..... B65H 19/1873 396/387
2003/0080235 A1 * 5/2003 Sato ..... B65H 19/1852 242/555.6
2004/0084561 A1 * 5/2004 Clifford ..... B65H 19/1852 242/598.2
2005/0051257 A1 * 3/2005 Hayasaka ..... B65H 19/1852 242/556.1
2005/0241774 A1 * 11/2005 Hart ..... B65H 23/032 242/551
2006/0169826 A1 * 8/2006 Benvenuti ..... B65H 19/12 242/555
2006/0175457 A1 * 8/2006 Benvenuti ..... B65H 19/126 242/555
2010/0170978 A1 * 7/2010 Muller ..... B65H 19/1852 242/552
2010/0186879 A1 * 7/2010 Machamer ..... B65H 19/20 156/159
2014/0034772 A1 * 2/2014 Giuliani ..... B65H 19/102 242/556.1
2015/0034758 A1 * 2/2015 Acciari ..... B65H 23/1825 242/555.4
2016/0068361 A1 * 3/2016 Machamer ..... B29C 66/87 156/159
2016/0159600 A1 * 6/2016 Pedercini ..... B65H 19/1842 242/555.3
2016/0244290 A1 * 8/2016 De Marco ..... B65H 19/1852
2017/0137247 A1 * 5/2017 Sato ..... B65H 19/1842
2017/0137248 A1 * 5/2017 Sato ..... B65H 19/102
2017/0137251 A1 * 5/2017 Sato ..... B65H 20/12
2017/0275116 A1 * 9/2017 Gnan ..... B65H 19/1852
2017/0341894 A1 * 11/2017 Muller ..... B65H 19/107
2019/0256314 A1 * 8/2019 Sato ..... B65H 19/105
2019/0270606 A1 * 9/2019 Sato ..... B65H 19/10
2020/0087093 A1 * 3/2020 Wakefield ..... B65H 21/00
2020/0255247 A1 * 8/2020 Ruhland ..... B65H 19/18
2020/0399086 A1 * 12/2020 Aprato ..... B65H 21/02
2021/0126277 A1 * 4/2021 Park ..... H01M 10/0404
2022/0274798 A1 * 9/2022 Ahn ..... B65H 19/1852
2022/0289509 A1 * 9/2022 Campedelli ..... B65H 21/00
2023/0008543 A1 * 1/2023 Torres Martinez ..... B25J 13/08
2023/0027935 A1 * 1/2023 Cao ..... B65H 19/1852

(56) References Cited

U.S. PATENT DOCUMENTS

| | | | | |
|---|---|---|---|---|
| 2023/0123540 | A1* | 4/2023 | Cao | B65H 19/30 242/532.3 |
| 2023/0373744 | A1* | 11/2023 | Cao | H01M 10/0409 |
| 2023/0373745 | A1* | 11/2023 | Cini | B65H 19/1873 |
| 2023/0406662 | A1* | 12/2023 | Cini | B65H 19/1863 |

FOREIGN PATENT DOCUMENTS

| | | | | |
|---|---|---|---|---|
| CN | 218491056 | U | 2/2023 | |
| CN | 218491058 | U | 2/2023 | |
| EP | 3212552 | B1 * | 9/2019 | B65H 19/1873 |
| EP | 3698959 | A1 * | 8/2020 | B65H 19/20 |
| WO | WO-2022170777 | A1 * | 8/2022 | B65H 19/1852 |
| WO | WO-2024074325 | A1 * | 4/2024 | B65H 21/00 |

* cited by examiner

AUTOMATIC ROLL-REPLACING APPARATUS

CROSS-REFERENCE TO RELATED APPLICATIONS

This application is a National Stage of International Application No. PCT/CN2022/135488, filed on Nov. 30, 2022, which claims priority to Chinese Patent Application No. 202222914721.6, filed on Nov. 2, 2022 and Chinese Patent Application No. 202210773819.6, filed on Jul. 1, 2022, all of which are hereby incorporated by reference in their entireties.

TECHNICAL FIELD

The present application relates to a technical field of battery manufacturing, and specifically to an automatic roll-replacing apparatus.

BACKGROUND

In a manufacturing process of lithium batteries, in order to form a battery cell, it is necessary to wind a plurality of winding material strips (such as a cathode pole piece, a diaphragm, and an anode pole piece). The incoming material for the winding material strips is generally a material roll, which are to be loaded with an unwinding mechanism. The unwinding mechanism drives material rolls to rotate so as to unwind and output wound material strips.

In an actual production process, when material rolls (especially diaphragm material rolls) are used up, it is necessary to first suspend the winding operation, then manually replace the material roll and connect the strips. The winding operation cannot be continued until roll-replacement is completed, bringing disadvantages such as high labor cost, low production efficiency, and low automation degree.

SUMMARY

Based on this, in view of problems of high labor cost, limited automation degree and low production efficiency in the prior art, which requires manual replacement of material rolls and connect strips, it is necessary to provide an automatic roll-replacing apparatus to improve the above-mentioned defects.

An automatic roll-replacing apparatus comprising:

an unwinding device for loading a working material roll and a standby material roll and for driving the working material roll to unwind and output a working material strip;

a starting-end-handling device comprising a support mechanism and a pick-up mechanism, the support mechanism is located between the standby material roll and the working material roll; the pick-up mechanism is configured to pick up a material strip starting end of a standby material strip, and pull the material strip starting end to reach a location between the support mechanism and the working material roll, so that the standby material strip is wound onto and passed through the support mechanism; and a strip-connecting device comprising two strip-connecting mechanisms of which either one carries a tape, the strip-connecting mechanism carrying the tape is configured to press a first portion of the tape and the standby material strip against one side of the support mechanism; the strip-connecting mechanism not carrying the tape is configured to press the working material strip against an opposite side of the support mechanism, cut off the working material strip from an upstream side of the support mechanism, and press the working material strip against a second portion of the tape on a downstream side of the support mechanism.

In one embodiment, the support mechanism can be controlled to move between an avoidance position and a strip-connecting position in a first direction, the unwinding device comprises two unwinding mechanisms spaced along a second direction intersecting the first direction, two material rolls loaded on the two unwinding mechanisms are used alternately as the working material roll and the standby material roll respectively;

the pick-up mechanism can be controlled to move between the two unwinding mechanisms to pull the material strip starting end through between the avoidance position and the strip-connecting position, so that the standby material strip is wound onto and passed through the support mechanism when the support mechanism is moving from the avoidance position to the strip-connecting position.

In one embodiment, the support mechanism further comprises a support block which can move in a controlled way along the first direction, the support block has a first adsorption surface on each of the two sides thereof in the second direction, and the first adsorption surface is configured to adsorb the standby material strip.

In one embodiment, the support mechanism further comprises a first support roller rotatably provided on the support block, the first support roller is located on one side of the support block facing towards the avoidance position; each of the strip-connecting mechanisms has an abutting roller which is rotatable;

in the strip-connecting position, the abutting roller of the strip-connecting mechanism carrying the tape is configured to press the standby material strip against the first support roller, and the abutting roller of the strip-connecting mechanism not carrying the tape is configured to press the working material strip against the first support roller.

In one embodiment, the support mechanism further comprises a second support roller rotatably provided on the support block, and the second support roller is located on one side of the support block facing towards the strip-connecting position and for the standby material strip to be wound onto and passed through.

In one embodiment, the starting-end-handling device further comprises a first swing mechanism which is in driving connection with the pick-up mechanism, and the first swing mechanism is configured to drive the pick-up mechanism to swing between the two unwinding mechanisms.

In one embodiment, the strip-connecting device further comprises two second swing mechanisms in one-to-one correspondence to the two strip-connecting mechanisms, each of the second swing mechanisms is in driving connection with a corresponding strip-connecting mechanism to drive the corresponding the strip-connecting mechanism to swing in a direction close to or away from the support mechanism.

In one embodiment, the pick-up mechanism comprises a mounting seat and a gripping assembly provided on the mounting seat, the gripping assembly having a first gripping member and a second gripping member disposed opposite each other; a gripping space is formed between the first gripping member and the second gripping member for gripping the material strip starting end on the standby material roll, and at least one of the first gripping member and the second gripping member can get close to or far away from the other;

wherein the mounting seat can be controlled to drive the gripper assembly to move to the standby material roll to grip the material strip starting end, and drive the gripper assembly to move so as to pull the standby material strip to be wound onto and passed through the support mechanism.

In one embodiment, the first gripping member has a second adsorption surface on one side thereof facing the second gripping member, and the second gripping member has a blowing surface on one side thereof facing the first gripping member;

when the mounting seat drives the gripping assembly to move to the standby material roll, the blowing surface blows an edge portion of the material strip starting end towards the second adsorption surface and the edge portion is adsorbed by the second adsorption surface.

In one embodiment, the pick-up mechanism comprises:

a mounting seat which can be controlled to move close to or away from the standby material roll;

a sticking assembly comprising a tape-unwinding structure, a tape-winding structure and a sticking member all provided on the mounting seat; the tape-unwinding structure is configured to output a tape material strip to the sticking member so as to wind the tape material strip through the sticking member, and one side of the tape material strip facing away from the sticking member is an adhesive side; the tape-winding structure is configured to wind the tape material strip having been wound onto and passed through the sticking member;

wherein, when the mounting seat is moving close to the standby material roll, the mounting seat is capable of driving the sticking member to be pressed against the standby material roll, so that the tape material strip on the sticking member sticks the material strip starting end of the standby material roll.

In one embodiment, the sticking member is a sticking roller which is connected to the mounting seat in a way that the sticking roller is rotatable about its own axis.

In one embodiment, when the mounting seat drives the sticking roller to be pressed against the standby material roll, the tape-winding structure winds the tape material strip and drives the sticking roller to rotate, the standby material roll rotates to unwind the standby material strip, and the sticking roller rotates in a direction opposite to a rotating direction of the standby material roll.

In one embodiment, the support mechanism has an avoidance state and a strip-connecting state;

when the support mechanism is in the avoidance state, the support mechanism provides collision avoidance for movement of the sticking member driven away from the standby material roll by the mounting seat;

when the support mechanism is in the strip-connecting state, the support mechanism is configured to be wound onto and passed through by the standby material strip pulled out by the tape material strip on the sticking member.

In one embodiment, the support mechanism comprises a transferring seat and a support block, one end of the support block is rotatably connected to the transferring seat;

wherein, when the support mechanism is in the strip-connecting state, the support block is swung relative to the transferring seat until a length direction of the support block is parallel to a width direction of the standby material strip; and when the support mechanism is in the avoidance state, the support block is swung relative to the transferring seat until the length direction of the support block intersects the width direction of the standby material strip.

In one of the embodiments, each of the strip-connecting mechanisms has a first abutting portion and a second abutting portion that carry the tape together;

when the strip-connecting mechanism carrying the tape moves to a strip-connecting position, it presses the tape and the standby material strip against one side of the support mechanism with the first abutting portion of itself;

when the strip-connecting mechanism not carrying the tape moves to the strip-connecting position, it presses the working material strip against the other side of the support mechanism with the first abutting portion of itself and presses the working material strip against the strip-connecting mechanism carrying the tape with the second abutting portion of itself from the downstream side of the support mechanism until it presses against the second abutting portion of the strip-connecting mechanism carrying the tape.

In one of the embodiments, each of the strip-connecting mechanisms further comprises a cutting member for cutting off the working material strip, the cutting member is located on one side of the first abutting portion facing away from the second abutting portion.

In one embodiment, each of the strip-connecting mechanisms can be controlled to move between a respective tape preparation position and the strip-connecting position;

the strip-connecting device further includes a tape preparation mechanism, the tape preparation mechanism comprising a moving seat and a tape supply assembly provided on the moving seat, the tape supply assembly has a tape supplying sucker for adsorbing the tape, the tape supplying sucker can move in a controlled way in a first predetermined direction;

the moving seat can move in a controlled way to the tape preparation position of each of the strip-connecting mechanisms; when the moving seat is moved to the tape preparation position of any one of the strip-connecting mechanisms, the tape supplying sucker is disposed opposite to the first and the second abutting portions of its corresponding strip-connecting mechanism in the first predetermined direction.

In one embodiment, the strip-connecting device further comprises a cylinder conveying mechanism and a cylinder collecting mechanism, the cylinder conveying mechanism is mounted on the moving seat and the cylinder collecting mechanism is arranged in a first position; the unwinding device comprises two unwinding mechanisms respectively arranged in a second position and a third position;

the moving seat can be controlled to move between the first position, the second position and the third position; when the moving seat moves to the second position or the third position, the cylinder conveying mechanism grips an empty cylinder on a corresponding unwinding mechanism; when the moving seat moves to the first position, the cylinder conveying mechanism transfers the gripped empty cylinder to the cylinder collecting mechanism.

In one embodiment, the unwinding device comprises two unwinding mechanisms, the automatic roll-replacing apparatus further comprising a guide device for guiding the working material strip unwound and output by either of the two unwinding mechanisms;

each of the unwinding mechanisms comprising an aligning assembly and an unwinding assembly mounted at one driving end of the aligning assembly, the unwinding assembly has an unwinding shaft for loading the working material roll or the standby material roll, and the aligning assembly is configured to drive the unwinding assembly to move axially along the unwinding shaft;

the guide device comprises a fixed seat, a guide frame, a guide roller and a switching mechanism; the guide frame is movably connected to the fixed seat in a direction parallel to an axial direction of the unwinding shaft, the guide roller is mounted on the guide frame, and the switching mechanism is connected to the guide frame and is selectively connected to either of the unwinding assemblies of the two unwinding mechanisms.

In one embodiment, the unwinding device comprises two unwinding mechanisms, each of the unwinding mechanisms comprises an unwinding assembly and a material-prodding assembly, the unwinding assembly comprises a carrier seat, a carrier shaft and an unwinding shaft;

the carrier shaft is mounted on the carrier seat, the unwinding shaft is coaxially provided on the carrier shaft and has a mounting section and an unwinding section, the unwinding shaft is rotatable about its own axis and axially movable relative to the carrier shaft, and the unwinding shaft is able to drive the unwinding section to axially dock with the carrier shaft or separate from the carrier shaft during its axial movement relative to the carrier shaft;

wherein the carrier shaft is configured to carry one or more standby material rolls, and the material-prodding assembly is configured to prod the standby material roll on the carrier shaft toward the unwinding section.

Regarding the above-mentioned automatic roll-replacing apparatus, in the actual production process, initially, the unwinding device is loaded with a working material roll and a standby material roll, and drives the working material roll to rotate while conveying the working material strip downstream. For the purpose of description, the two strip-connecting mechanisms are named a first strip-connecting mechanism and a second strip-connecting mechanism respectively. Initially, the first strip-connecting mechanism carries tapes. The second strip-connecting mechanism does not carry any tape.

When the unwinding of the working material roll is finished, automatic roll-replacement is required. First, the pick-up mechanism picks up a material strip starting end of a standby material roll on the unwinding device, and pulls the material strip starting end to a place between the support mechanism and the working material roll, so that the pulled-out standby material strip is wound onto and passed through the support mechanism. At this time, the standby material strip between the support mechanism and the standby material roll is a first standby material strip section, and the standby material strip between the support mechanism and the material strip starting end is a second standby material strip section. Then, the first strip-connecting mechanism is controlled to move toward the support mechanism, so that this first strip-connecting mechanism presses the first portion of the tape and the first standby material strip section thereon against one side of the support mechanism, i.e., the first portion of the tape is bonded to the standby material strip. Then, the second strip-connecting mechanism is controlled to move towards the support mechanism, so that the second strip-connecting mechanism presses the working material strip and the second standby material strip section against the other side of the support mechanism.

Then, the second strip-connecting mechanism is controlled to cut off the working material strip from the upstream side of the support mechanism, and the second strip-connecting mechanism is controlled to press the working material strip against the second portion of the tape on the first strip-connecting mechanism at the downstream side of the support mechanism, so that the working material strip is bonded to the second portion of the tape on the first strip-connecting mechanism. At this time, the first portion of the tape is bonded to the standby material strip, and the second portion of the tape is bonded to the working material strip, i.e., the standby material strip and the working material strip are bonded together by the tape, thereby realizing the strip-connecting.

Then, the first strip-connecting mechanism and the second strip-connecting mechanism are controlled to move away from the support mechanism, respectively, in preparation for the next automatic roll-replacing. At this time, the standby material roll on the unwinding device is switched to the working material roll, and is driven to rotate by the unwinding device to continue unwinding and outputting the working material strip downstream. And, the empty cylinder on the unwinding device (it should be noted that the material roll is formed by winding the material strip on the empty cylinder, and the empty cylinder is left after the unwinding of the material strip is finished) can be replaced with a new material roll. The new material roll is used as a standby material roll to switch to a working material roll after the next automatic roll-replacement. The next automatic roll-replacing process is similar to the above roll-replacing process, which is not limited here.

In this way, the automatic roll-replacing apparatus of the present application can realize automatic switching of working material rolls and standby material rolls (i.e., automatic roll-replacement) without using manual roll-replacing, which reduces labor costs, has a high degree of automation, and is advantageous to improving production efficiency.

BRIEF DESCRIPTION OF THE DRAWINGS

In order to clearly illustrate embodiments of the present application or technical solutions in the prior art, accompanying drawings that need to be used in description of the embodiments or the prior art will be briefly introduced as follows. Obviously, drawings in following description are only the embodiments of the present application. For those skilled in the art, other drawings can also be obtained according to the disclosed drawings without creative efforts.

DETAILED DESCRIPTION

In the following, the technical solutions in the embodiments of the present application will be clearly and thoroughly described in conjunction with the accompanying drawings in the embodiments of this application. It is apparent that the embodiments described are only a part of the embodiments of this application, and not all of them. Based on the embodiments in the present application, all other embodiments obtained by a person of ordinary skill in the art without creative labor fall within the scope of the present application.

In addition, terms "first" and "second" are only used for descriptive purposes, and should not be understood as indicating or implying relative importance or implying a number of indicated technical features. Therefore, features defined with "first", "second" may expressly or implicitly include at least one of those features. In the description of the present application, "plurality" means at least two, such as two, three, etc., unless expressly and specifically defined otherwise.

In the present application, unless otherwise expressly specified and limited, terms "mounted", "be connected with", "be connected to", "fixed" and other terms should be interpreted in a broad sense, for example, it can be a fixed connection, a detachable connection, or an integrated as a whole; it can be a mechanical connection or an electrical connection; it can be a direct connection or an indirect connection through an intermediate medium; it may be connection within the two elements or an interaction relationship between the two elements, unless explicitly defined otherwise. For those of ordinary skill in the art, the specific meanings of the above-mentioned terms in the present application can be understood according to specific situations.

A first embodiment of the present application provides an automatic roll-replacing apparatus comprising an unwinding device, a starting-end-handling device, and a strip-connecting device.

Figure 1:
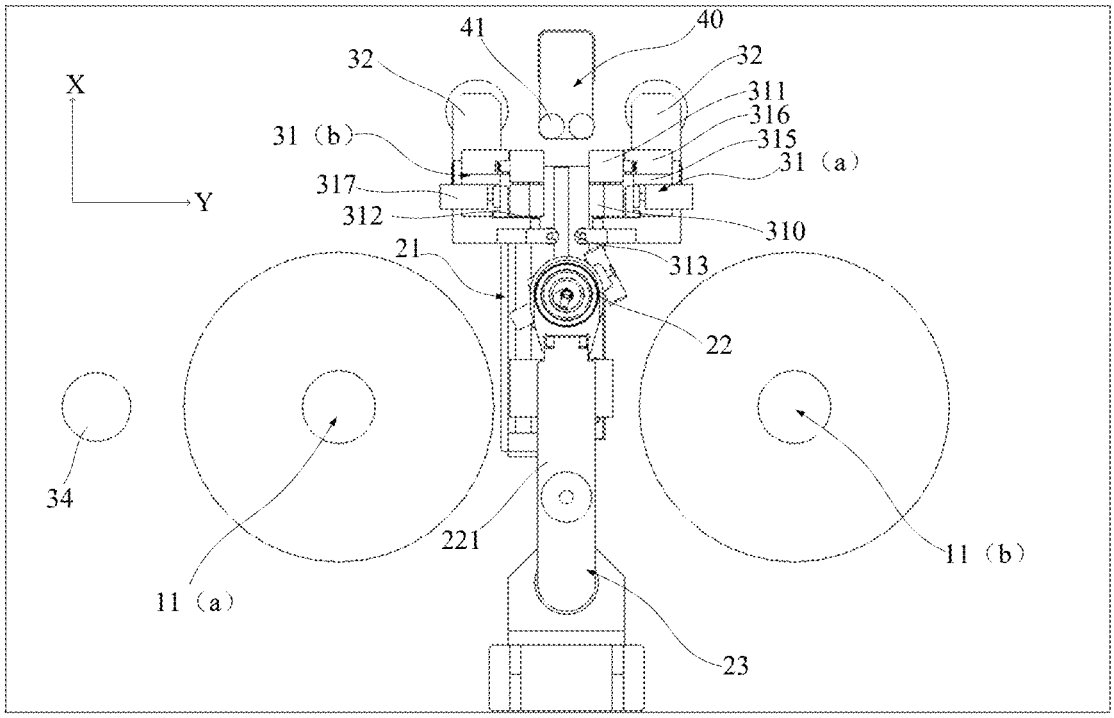
FIG. 1 a main view of the automatic roll-replacing apparatus in an embodiment of the present application (omitting the tape preparation mechanism)

Referring to FIG. 1, the unwinding device is configured to load a working material roll A1 (see FIG. 3) and a standby material roll A2 (see FIG. 3), and drives the working material roll A1 to unwind downstream to output a working material strip B1. It is also noted that in one embodiment of the present application, the working material strip B1 and the standby material strip B2 may be diaphragms, that is, the working material roll A1 and the standby material roll A2 are diaphragm material rolls. Of course, in other embodiments, the working material strip B1 and the standby material strip B2 may also be other types of material strips, without being limited herein.

The starting-end-handling device comprises a support mechanism 21 and a pick-up mechanism 22. The support mechanism 21 is positioned between the working material roll A1 and the standby material roll A2 of the unwinding device. The pick-up mechanism 22 is configured to pick up a material strip starting end B21 of the standby material roll A2 on the unwinding device, and to pull the material strip starting end B21 (see FIG. 3) to reach a location between the support mechanism 21 and the working material roll A1, so that the pulled-out standby material strip B2 is wound onto and passed through the support mechanism 21.

Figure 2:
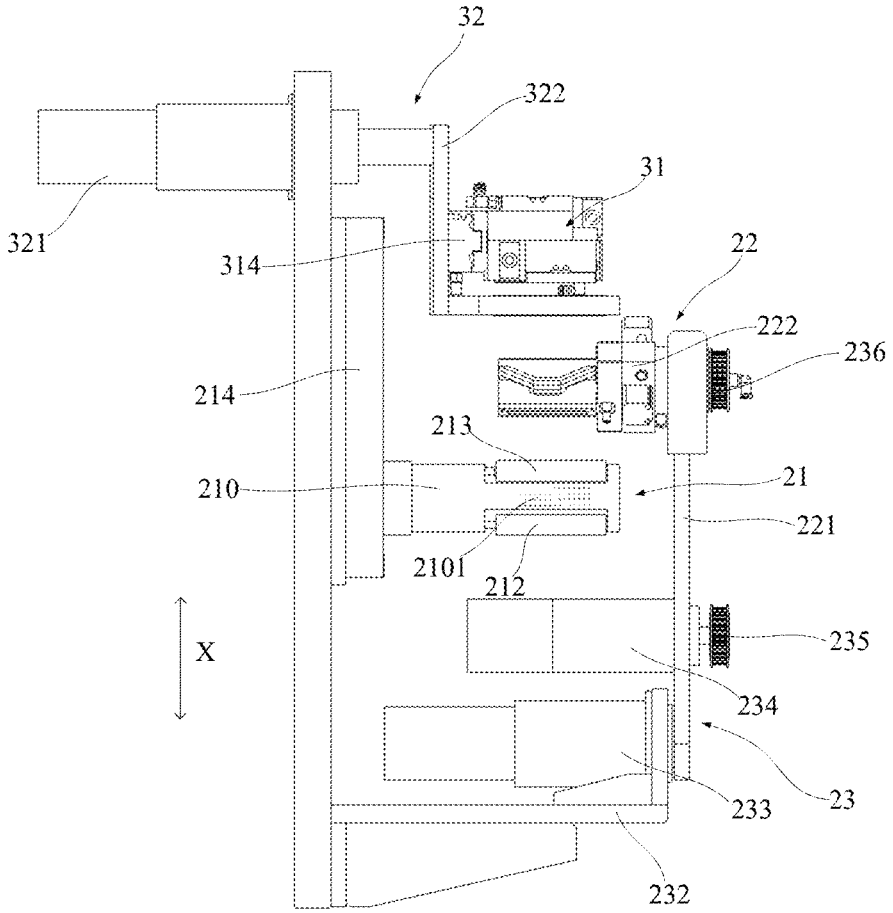
FIG. 2 shows a side view of the automatic roll-replacing apparatus shown in FIG. 1 (the tape preparation mechanism is omitted)
Figure 3:
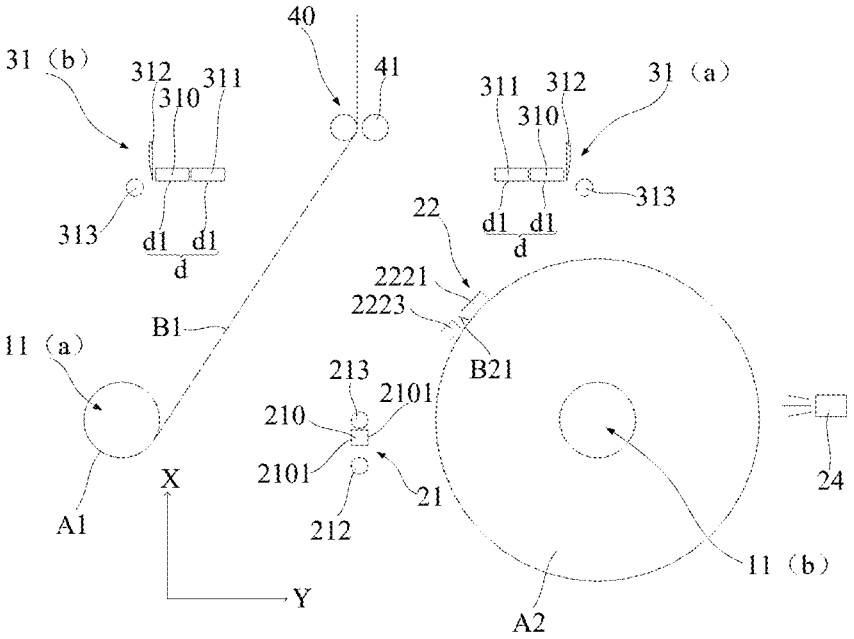
FIGS. 3 to 7 show a view of demonstrating the automatic roll-replacing process of the automatic roll-replacing apparatus shown in FIG. 1.
Figure 5:
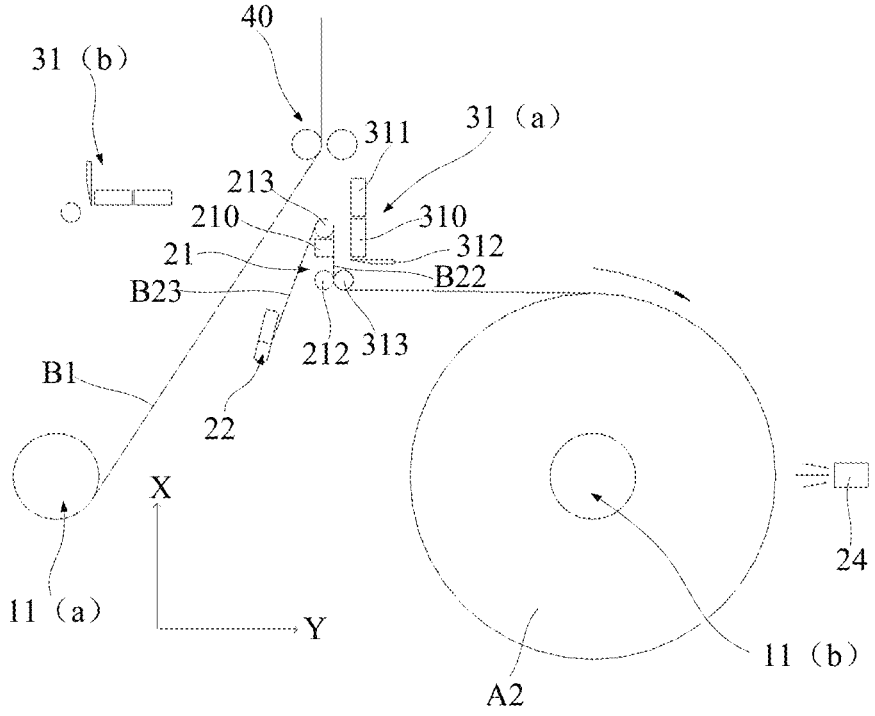

Referring to FIGS. 1 to 3, the strip-connecting device includes two strip-connecting mechanisms 31 of which either one carries a tape C. That is, when one of the two strip-connecting mechanisms 31 carries the tape C, the other one does not carry the tape C. The strip-connecting mechanism 31 with the tape C is configured to press a first portion of the tape C and the standby material strip B2 against one side of the support mechanism 21, such that the first portion of the tape C is bonded to the standby material strip B2. The other strip-connecting mechanism 31 not carrying the tape C is configured to press the working material strip B1 against an opposite side of the support mechanism 21. The working material strip B1 is cut off from an upstream side of the support mechanism 21 (i.e., a lower side of the support mechanism 21 as shown in FIG. 5), and the working material strip B1 is pressed against a second portion of the tape C a downstream side of the support mechanism 21 (i.e., an upper side of the support mechanism 21 as shown in FIG. 5), so that the working material strip B1 is bonded to the second portion of the tape C. At this point, the working material strip B1 and the standby material strip B2 are bonded to the same tape C, i.e., a strip-connection is achieved.

In the above-mentioned automatic roll-replacing apparatus, in the actual production process, initially, the unwinding device is loaded with a working material roll A1 and a standby material roll A2. The working material roll A1 is driven to rotate to convey the working material strip B1 downstream. For the purpose of description, the two strip-connecting mechanisms 31 are named a first strip-connecting mechanism 31*a* and a second strip-connecting mechanism 31*b* respectively. Initially, the first strip-connecting mechanism 31*a* carries the tape C. The second strip-connecting mechanism 31*b* does not carry the tape C.

Referring to FIGS. 3 to 8, when unwinding of the working material roll A1 is completed, an automatic roll-replacement is required. First, the pick-up mechanism 22 picks up the material strip starting end B21 of the standby material roll A2 on the unwinding device, and pulls the material strip starting end B21 to reach the place between the support mechanism 21 and the working material roll A1, so that the pulled-out standby material strip B2 is wound onto and passed through the support mechanism 21. At this time, the standby material strip B2 between the support mechanism 21 and the standby material roll A2 is a first standby material strip section B22 (see FIG. 5), and the standby material strip B2 between the support mechanism 21 and the material strip starting end B21 is a second standby material strip section B23 (see FIG. 5). Then, the first strip-connecting mechanism 31*a* is controlled to move toward the support mechanism 21, such that the first strip-connecting mechanism 31*a* presses the first portion of the tape C and the first standby material strip section B22 thereon against one side of the support mechanism 21, i.e., the first portion of the tape C is bonded to the standby material strip B2. Then, the second strip-connecting mechanism 31*b* is controlled to move towards the support mechanism 21 such that the second strip-connecting mechanism 31*b* presses the working material strip B1 and the second standby material strip section B23 against the other side of the support mechanism 21.

Then, the second strip-connecting mechanism 31*b* is controlled to cut off the working material strip B1 from the upstream side of the support mechanism 21, and the second strip-connecting mechanism 31*b* is controlled to press the working material strip B1 at the downstream side of the support mechanism 21 against the second portion of the tape C on the first strip-connecting mechanism 31*a*, so that the working material strip B1 is bonded to the second portion of the tape C on the first strip-connecting mechanism 31*a*. At this time, the first portion of the tape C is bonded to the standby material strip B2, and the second portion of the tape C is bonded to the working material tape B1, i.e., the standby material strip B2 and the working material strip B1 are bonded together by means of the tape C, so as to achieve a strip-connection.

Then, the first strip-connecting mechanism 31*a* and the second strip-connecting mechanism 31*b* are controlled to move away from the support mechanism 21 respectively, in preparation for the next automatic roll-replacing. At this time, the standby material roll A2 on the unwinding device switches to the working material roll A1 which is driven by the unwinding device to rotate to continue unwinding downstream to output the working material strip B1. An empty cylinder A3 on the unwinding device (it should be noted that a material roll is formed by winding the material strip around the empty cylinder A3, and what remains after the unwinding of the working material roll A1 is completed is the empty cylinder A3) can be replaced with a new material roll, which is used as the standby material roll A2. The next automatic roll-replacing process is similar to the above roll-replacing process, which is not limited here.

In this way, the automatic roll-replacing apparatus of the present application can realize automatic switching of working material roll A1 and standby material roll A2 (i.e., automatic roll-replacement) without manual replacement of rolls, thereby reducing labor costs and increasing automation degree and production efficiency.

It should be noted that the working material roll A1 refers to a material roll driven by the unwinding device to rotate and convey the working material strip B1 downstream. The working material strip B1 refers to the strip on the working material roll A1. The standby material roll A2 refers to a material roll on the unwinding device that does not convey a strip downstream. The standby material strip B2 refers to the strip on the standby material roll A2. It should be understood that, after the automatic roll-replacement, the standby material roll A2 is switched to the working material roll A1, and the working material strip B1 is conveyed downstream. At the same time, an empty cylinder A3 is formed after the unwinding of the working material roll A1 is completed, the empty cylinder A3 can be replaced with a new material roll, and the new material roll is used as the standby material roll A2.

It should be further noted that the upstream and downstream of the support mechanism 21 herein are relative to the working material strip B1, i.e., an end of the support mechanism 21 which is closer to the downstream side of the working material strip B1 is the downstream end, and the other end which is closer to the upstream side of the working material strip B1 is the upstream end. In specific embodiments shown in the accompanying drawings, the lower side of the support mechanism 21 is the upstream side, and the upper side of the support mechanism 21 is the downstream side.

Figure 8:
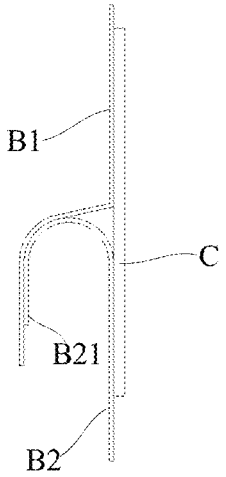
FIG. 8 shows a schematic diagram of the structure at a place strip-connecting a working material strip and a standby material strip.

Referring to FIG. 8, it should also be noted that after the automatic roll-replacement is completed, tape C is applied to only one side of a strip-connecting place of the working material strip B1 and the standby material strip B2, and a certain length of the cut-off end of the working material strip B1 and the material strip starting end B21 of the standby material strip B2 remain on one side of the strip-connecting place of the working material strip B1 and the standby material strip B2 which is away from tape C. Since the diaphragm is made of a light and soft material, only one single side thereof is bonded to the tape. As such, the diaphragm will remain available for use even if the cut-off end of the working material strip B1 and the material strip starting end B21 of the standby material strip B2 are of excessive length.

In one specific embodiment, the automatic roll-replacing apparatus has a first roll-replacing state and a second roll-replacing state. When the automatic roll-replacing apparatus is in the first roll-replacing state, the first strip-connecting mechanism 31*a* carries a tape C. When the first strip-connecting mechanism 31*a* and the second strip-connecting mechanism 31*b* move to the support mechanism 21 and come into contact with opposite sides of the support mechanism 21 respectively, the first strip-connecting mechanism 31*a* presses a first portion of the tape C and a first standby material strip section B22 against one side of the support mechanism 21 (i.e., right side of the support mechanism 21 shown in FIG. 5). Also, the second strip-connecting mechanism 31*b* presses the working material strip B1 and the second standby material strip section B23 on the other side of the support mechanism 21 (i.e., left side of the support mechanism 21 shown in FIG. 5). In this state, the second strip-connecting mechanism 31*b* can be controlled to cut the working material strip B1 and to press the working material strip B1 against the second portion of the tape C on the first strip-connecting mechanism 31*a*, so that the working material strip B1 and the standby material strip B2 are bonded together by the tape C to complete the strip-connection.

When the automatic roll-replacing apparatus is in the second roll-replacing state, the second strip-connecting mechanism 31*b* carries a tape C. When the first strip-connecting mechanism 31*a* and the second strip-connecting mechanism 31*b* move to the support mechanism 21 and come into contact with opposite sides of the support mechanism 21 respectively, the second strip-connecting mechanism 31*b* presses a first portion of the tape C and a first standby material strip section B22 against one side of the support mechanism 21 (i.e., left side of the support mechanism 21 as shown in FIG. 5). Also, the first strip-connecting mechanism 31*a* presses the working material strip B1 and the second standby material strip section B23 against the other side of the support mechanism 21 (i.e., right side of the support mechanism 21 as shown in FIG. 5). In this state, the first strip-connecting mechanism 31*a* can be controlled to cut off the working material strip B1 and to press the working material strip B1 against a second portion of the tape C of the second strip-connecting mechanism 31*b*, so that the working material strip B1 and the standby material strip B2 are bonded together by the tape C to complete the strip-connection.

Figure 4:
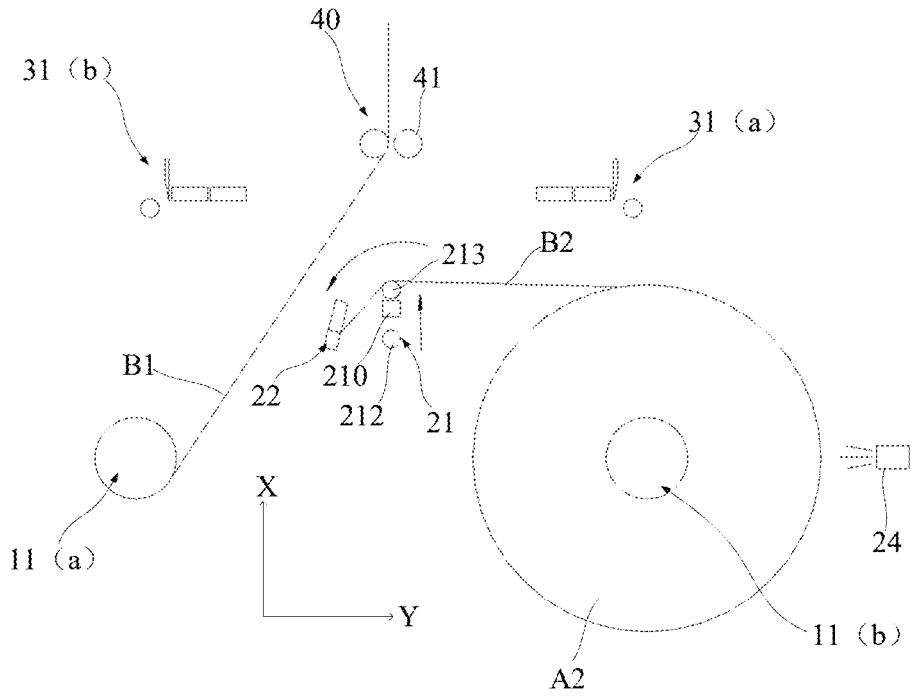

In one specific embodiment, the support mechanism 21 can be controlled to move between an avoidance position (i.e., a position in which the support mechanism 21 is located in FIG. 4) and a strip-connecting position (i.e., a position in which the support mechanism 21 is located in FIG. 5) in a first direction X. In a specific embodiment shown in FIGS. 3 to 7, the strip-connecting position is located above the avoidance position. The unwinding device comprises two unwinding mechanisms 11 spaced along a second direction Y intersecting the first direction X. The material rolls loaded on the two unwinding mechanisms 11 are alternatively used as the working material roll A1 and the standby material roll A2 respectively. The pick-up mechanism 22 can be controlled to move between the two unwinding mechanisms 11 to pull the material strip starting end B21 through between the avoidance position and the strip-connecting position, such that the pulled-out standby material strip B2 is located between the avoidance position and the strip-connecting position, thereby causing the standby material strip B2 to be wound on the support mechanism 21 when the support mechanism 21 is moved from the avoidance position to the strip-connecting position. Preferably, the first direction X is perpendicular to the second direction Y. In a specific embodiment shown in FIG. 1, the first direction X is an up-down direction, and the second direction Y is a left-right direction.

Referring to FIGS. 3 to 8, the two unwinding mechanisms 11 are named a first unwinding mechanism 11*a* and a second unwinding mechanism 11*b* for convenience of description. If initially, the material roll on the first unwinding mechanism 11*a* is a working material roll A1 and conveys a working material strip B1 downstream. The material roll on the second unwinding mechanism 11*b* is a standby material roll A2, and the first strip-connecting mechanism 31*a* carries a tape C.

When the unwinding of the working material roll A1 on the first unwinding mechanism 11*a* is completed and automatic roll-replacement is required, first, the pick-up mechanism 22 moves towards the standby material roll A2 on the second unwinding mechanism 11*b* until it picks up the material strip starting end B21 on this standby material strip B2 (see FIG. 3). The pick-up mechanism 22 then moves to the left, thereby pulling the material strip starting end B21 by passing between the avoidance position and the strip-connecting position. Then, the support mechanism 21 moves upwards from the avoidance position to the strip-connecting position, such that the standby material strip B2 is wound onto and passed through the upper side of the support mechanism 21 (see FIG. 4). At this time, the portion of the standby material strip B2 between the support mechanism 21 and the standby material roll A2 (i.e., right side of the support mechanism 21) is the first standby material strip section B22; the portion of the standby material strip B2 between the support mechanism 21 and the pick-up mechanism 22 (i.e., left side of the support mechanism 21) is the second standby material strip section B23. Then, the first strip-connecting mechanism 31*a* is controlled to move toward the support mechanism 21 in the strip-connecting position, such that this first strip-connecting mechanism 31*a* abuts against the right side of the support mechanism 21, thereby causing the first standby material strip section B22 between the support mechanism 21 and the first strip-connecting mechanism 31*a* to be bonded to the first portion of the tape C (see FIG. 5). Then, the second strip-connecting mechanism 31*b* moves towards the support mechanism 21 in the strip-connecting position, such that the second strip-connecting mechanism 31*b* abuts against the left side of the support mechanism 21, which causes the support mechanism 21 and the second strip-connecting mechanism 31*b* to jointly press the working material strip B1 and the second standby material strip section B23 (see FIG. 6). Then, the second strip-connecting mechanism 31*b* is controlled to cut off the working material strip B1 from the upstream side of the support mechanism 21, and to press the working material strip B1 onto the second portion of the tape C of the first strip-connecting mechanism 31*a* at the downstream side of the support mechanism 21, causing the working material strip B1 to be bonded to the second portion of the tape C (see FIG. 7). At this time, the working material strip B1 and the right side of the standby material strip B2 are bonded by the adhesive tape C, i.e., the strip-connecting is realized. Finally, the first strip-connecting mechanism 31*a* moves to the right to the initial position, the second strip-connecting mechanism 31*b* moves to the left to the initial position, and the support mechanism 21 moves down to the avoidance position. At this time, the standby material roll A2 on the second unwinding mechanism 11*b* switches to the working material roll A1, and the second unwinding mechanism 11*b* drives the working material roll A1 on it to rotate while continuing to convey the working material strip B1 downstream.

The empty cylinder A3 on the first unwinding mechanism 11*a* may be replaced with a new material roll, which serves as a standby material roll A2. A tape preparation can be made to the second strip-connecting mechanism 31*b* in preparation for the next automatic roll-replacement.

When the unwinding of the working material roll A1 on the second unwinding mechanism 11*b* is completed and automatic roll-replacement is required again, first, the pick-up mechanism 22 moves toward the standby material roll A2 on the first unwinding mechanism 11*a* until it picks up the material strip starting end B21 on that standby material roll A2. Then, the pick-up mechanism 22 moves to the right, thereby pulling the material strip starting end B21 by passing between the avoidance position and the strip-connecting position. Then, the support mechanism 21 moves upwards from the avoidance position to the strip-connecting position, such that the standby material strip B2 is wound onto and passed through the upper side of the support mechanism 21. At this time, the portion of the standby material strip B2 between the support mechanism 21 and the standby material roll A2 (i.e., the left side of the support mechanism 21) is the first standby material strip section B22; the portion of the standby material strip B2 between the support mechanism 21 and the pick-up mechanism 22 (i.e., the right side of the support mechanism 21) is the second standby material strip section B23. Then, the second strip-connecting mechanism 31*b* is controlled to move toward the support mechanism 21 in the strip-connecting position, such that the second strip-connecting mechanism 31*b* abuts against the left side of the support mechanism 21, thereby causing the first standby material strip section B22 between the support mechanism 21 and the second strip-connecting mechanism 31 to be bonded to the tape C. Then, the first strip-connecting mechanism 31*a* moves toward the support mechanism 21 in the strip-connecting position, such that the first strip-connecting mechanism 31*a* abuts against the right side of the support mechanism 21, which causes the support mechanism 21 and the first strip-connecting mechanism 31*a* to jointly press the working material strip B1 and the second standby material strip section B23. Then, the first strip-connecting mechanism 31*a* is controlled to cut off the working material strip B1 from the upstream side of the support mechanism 21, and to press the working material strip B1 against the tape C of the second strip-connecting mechanism 31*b* at the downstream side of the support mechanism 21, causing the working material strip B1 to be bonded to the tape C on the second strip-connecting mechanism 31*b*. At this time, the working material strip B1 and the left side of the standby material strip B2 are bonded by the tape C, i.e., the strip-connecting is realized. Finally, the second strip-connecting mechanism 31*b* moves to the left to the initial position, the first strip-connecting mechanism 31*a* moves to the right to the initial position, and the support mechanism 21 moves down to the avoidance position. At this time, the standby material roll A2 on the first unwinding mechanism 11*a* is switched to the working material roll A1, and the first unwinding mechanism 11*a* drives the working material roll A1 on it to rotate while continuing to convey the working material strip B1 downstream.

Optionally, the pick-up mechanism 22 may move between two unwinding mechanisms 11 in a manner, for example, by swinging or moving in a straight line, to facilitate picking up the material strip starting end B21 on the standby material roll A2, and to pull the material strip starting end B21 through between the avoidance position and the strip-connecting position.

Referring to FIGS. 1 and 2, in one embodiment, the pick-up mechanism 22 moves between the two unwinding mechanisms 11 by swinging, to facilitate a reduction in occupying space near the support mechanism 21, and thereby leaving sufficient space for the support mechanism 21 to cooperate with the two strip-connecting mechanisms 31 for connecting the strips. Further, the starting-end-handling device also comprises a first swing mechanism 23 which is in driving connection with the pick-up mechanism 22, and the first swing mechanism 23 is configured to drive the pick-up mechanism 22 to swing between the two unwinding mechanisms 11 about the first swinging axis.

Further, the first swing mechanism 23 comprises a base 232 and a first swing actuator 233. The first swing actuator 233 is provided on the base 232, and the pick-up mechanism 22 is connected to an output shaft of the first swing actuator 233 to be driven by the first swing actuator 233 to swing about the first swinging axis, such that the pickup mechanism 22 is driven by the first swing actuator 233 to swing between the two unwinding mechanisms 11 about the first swinging axis. Optionally, the first swing actuator 233 may employ an electric motor. The first swinging axis is perpendicular to both the first direction X and the second direction Y.

Figure 9:
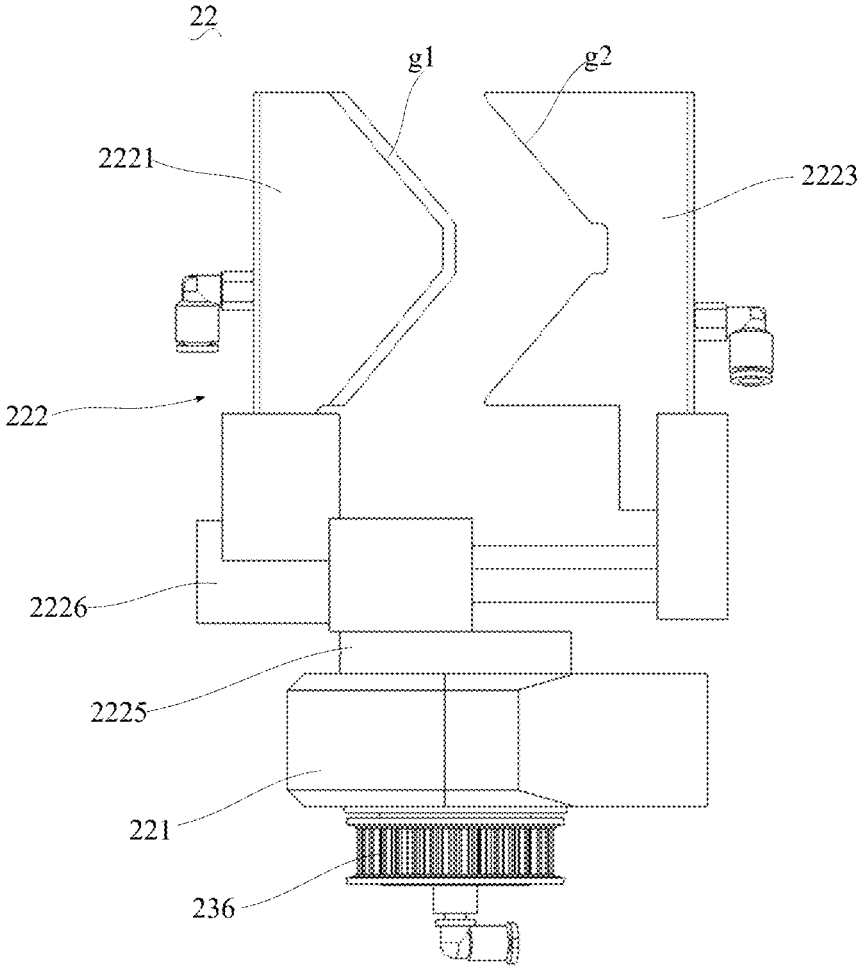
FIG. 9 is a schematic diagram of the structure of a pick-up mechanism of a starting-end-handling device of the automatic roll-replacing apparatus shown in FIG. 1.
Figure 10:
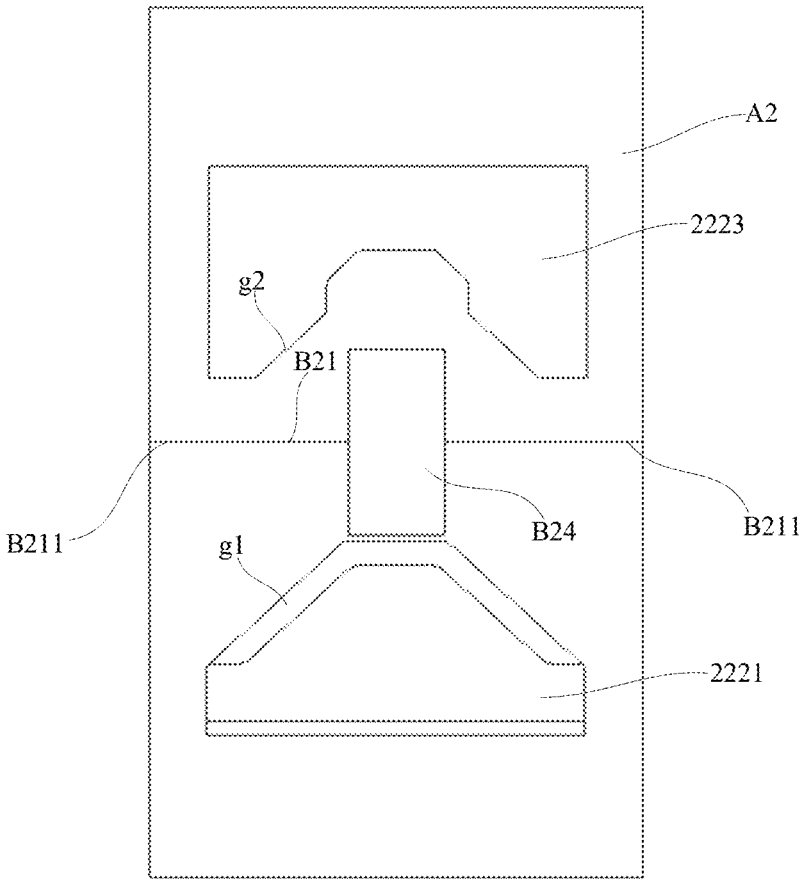
FIG. 10 shows a schematic diagram of the structure of the pick-up mechanism gripping a material strip starting end on the standby material strip shown in FIG. 9.

Referring to FIGS. 9 and 10, in one embodiment of the present application, the pick-up mechanism 22 comprises a mounting seat 221 and a gripping assembly 222 provided on the mounting seat 221. The gripping assembly 222 has a first gripping member 2221 and a second gripping member 2223 disposed opposite each other. A gripping space f is formed between the first gripping member 2221 and the second gripping member 2223 for gripping a material strip starting end B21 on a standby material roll A2. At least one of them can be close to or far away from the other, so as to clamp or loosen the material strip starting end B21. Wherein the mounting seat 221 is constructed to controllably drive the first gripping member 2221 and the second gripping member 2223 to move to the standby material roll A2, so as to grip the material strip starting end B21; and is constructed to drive the first gripping member 2221 and the second gripping member 2223 to pull the material strip starting end B21 so as to pass between the avoidance position and the strip-connecting position.

In this way, when it is necessary to pick up the material strip starting end B21 of the standby material roll A2, first, the mounting seat 221 is controlled to moved towards the standby material roll A2 until the first gripping member 2221 and the second gripping member 2223 of the gripping assembly 222 press against the standby material roll A2, so that the material strip starting end B21 on the standby material roll A2 is located between the first gripping member 2221 and the second gripping member 2223 (the standby material roll A2 may be rotated by the unwinding mechanism 11 until the material strip starting end B21 on the standby material roll A2 is a position between the first gripping member 2221 and the second gripping member 2223). Then, at least one of the first gripping member 2221 and the second gripping member 2223 is driven close to the other until the first gripping member 2221 and the second gripping member 2223 grip the material strip starting end B21. Then, the mounting seat 221 is controlled to move in a direction away from the standby material roll A2 until the material strip starting end B21 is pulled to pass between the avoidance position and the strip-connecting position, so that the standby material strip B2 is wound onto the support mechanism 21 when the support mechanism 21 is moved from the avoidance position to the strip-connecting position, and thus the strip-connection is completed with the cooperation of the two strip-connecting mechanisms 31.

In a specific embodiment, the mounting seat 221 is controllably moved to a gripping position close to the standby material roll A2 and a pulling position away from the standby material roll A2. When the mounting seat 221 is moved to the gripping position, the gripping assembly 222 grips the material strip starting end B21 on the standby material strip B2. When the mounting seat 221 is moved to the pulling position, the gripping assembly 222 pulls the gripped material strip starting end B21 by passing between the avoidance position and the strip-connecting position.

Specifically, one end of the mounting seat 221 is connected to the first swing actuator 233, and the gripping assembly 222 is mounted on the other end of the mounting seat 211, such that the gripping assembly 22 swings with the mounting seat 221 between the two unwinding mechanisms 11, thereby making the gripping assembly 222 to grip the material strip starting end B21 on the standby material roll A2 and pull the gripped material strip starting end B21 by passing between the avoidance position and the strip-connecting position.

Since a middle part of the material strip starting end B21 is initially fixed to the standby material roll A2 by the attaching member B24 (such as an adhesive strip, etc.), and edge portions B211 on both sides of the middle part of the material strip starting end B21 are in a free state. To accurately grip the material strip starting end B21, in a specific embodiment, the first gripping member 2221 has, on one side thereof facing the second gripping member 2223, a second adsorption surface g1; and the second gripping member 2223 has, on one side thereof facing the first gripping member 2221, a blowing surface g2. When the mounting seat 221 drives the first gripping member 2221 and the second gripping member 2223 to move to the standby material roll A2, the blowing surface g2 blows the edge portion B211 of the material strip starting end B21 facing towards the second adsorption surface g1 and the edge portion B211 is adsorbed by the second adsorption surface g1. At least one of the first gripping member 2221 and the second gripping member 2223 is brought closer relative to the other until the blowing surface g2 on the second gripping member 2223 clamps the edge portion B211 of the standby material strip B2 to the second adsorption surface g1 of the first gripping member 2221. In this way, the blowing surface g2 on the second gripping member 2223 is configured to blow up the edge portion B211 of the material strip starting end B21 onto the second adsorption surface g1 of the first gripping member 2221 before clamping; and then, the edge portion B211 of the material strip starting end B21 is clamped by the first gripping member 2221 and the second gripping member 2223, which edge portion B211 is adsorbed on the second adsorption surface g1.

Preferably, the first gripping member 2221 is fixed, and the second gripping member 2223 is capable of moving close to or away from the first gripping member 2221. In this way, when the material strip starting end B21 is clamped, the blowing surface g2 on the second gripping member 2223 blows air, so that the edge portion B211 of the material strip starting end B21 is blown up to the second adsorption surface g1 on the first gripping member 2221 and is adsorbed by the second adsorption surface g1. Then, the second gripping member 2223 is controlled to move close to the first gripping member 2221 until the first gripping member 2221 and the second gripping member 2223 clamp the edge portion B211 of the material strip starting end B21 between the blowing surface g2 and the second adsorption surface g1.

It should be noted that only the second gripping member 2223 moves close to the first gripping member 2221 while gripping the edge portion B211, and the first gripping member 2221 is fixed, thereby avoiding the edge portion B211 gradually moving away from the second adsorption surface g1 when the first gripping member 2221 moves, which results in the gripped edge portion B211 to be of a small area and unstable.

Further, there are two second adsorption surface g1 and two blowing surface g2, that is, the first gripping member 2221 has two second adsorption surfaces g1 on the side facing the second gripping member 2223, and the second gripping member 2223 has two blowing surfaces g2 on the side facing the first gripping member 2221. The two second adsorption surfaces g1 and the two blowing surfaces g2 are arranged opposite to each other in the direction from the first gripping member 2221 to the second gripping member 2223 (i.e., in the left-right direction in FIG. 9). That is, in the direction from the first gripping member 2221 to the second gripping member 2223, one of the second adsorption surfaces g1 is arranged opposite to one of the blowing surfaces g2, and the other second adsorption surface g1 is arranged opposite to the other blowing surface g2. In this way, when the mounting seat 221 is moved towards the standby material roll A2 until the first gripping member 2221 and the second gripping member 2223 of the gripping assembly 222 are driven against the standby material roll A2, one edge portion B211 of the material strip starting end B21 is positioned between one group of opposite second adsorption surfaces g1 and blowing surfaces g2, and the other edge portion B211 of the material strip starting end B21 is positioned between the other group of opposite second adsorption surface g1 and blowing surface g2. At this time, the two blowing surfaces g2 blow simultaneously, so that the two edge portions B211 are blown up onto the two second adsorption surfaces g1 and are adsorbed by the two second adsorption surfaces g1 respectively. Then, the second gripping member 2223 is controlled to move toward the first gripping member 2221 until the two blowing surfaces g2 on the second gripping member 2223 clamp the two edge portions B211 onto the two second adsorption surfaces g1 respectively, further improving robustness of the gripping of the material strip starting end B21.

Preferably, each second adsorption surface g1 and the corresponding blowing surface g2 are parallel to each other, so that the second adsorption surface g1 fits tightly to the opposite blowing surface g2 when gripping the edge portion B211, enhancing robustness of the gripping of the edge portion B211.

In a specific embodiment, in the direction from the first gripping member 2221 to the second gripping member 2223, the spacing between the two blowing surfaces g2 gradually decreases and the spacing between the two second adsorption surfaces g1 also gradually decreases, thereby ensuring that the blowing surface g2 can blow up as much material of the edge portion B211 to the corresponding second adsorption surface g1, thereby enabling as much material as possible of the edge portion B211 to be clamped and fixed, further enhancing the stability of the clamping.

In some embodiments, the gripping assembly 222 is rotatably attached to the mounting seat 221 about a rotation axis, and an arranging direction from the first gripping member 2221 to the second gripping member 2223 is perpendicular to the rotation axis. In this way, the spatial angle of the first gripping member 2221 and the second gripping member 2223 can be adjusted by controlling the rotation of the gripping assembly 222 about the rotation axis, such that when the first gripping member 2221 and the second gripping member 2223 follow the mounting seat 221 as it swings to the standby material roll A2, both the first gripping member 2221 and the second gripping member 2223 are against the circumferential surface of the standby material roll A2, and the first gripping member 2221 and the second gripping member 2223 are spaced apart along the circumference of the standby material roll A2, so that the first gripping member 2221 and the second gripping member 2223 can accurately grip the material strip starting end B21 on the standby material roll A2.

In a specific embodiment, the gripping assembly 222 further includes a rotating seat 2225 and a gripping drive 2226. The rotating seat 2225 is rotatably attached to the mounting seat 221 about a rotation axis. The first gripping member 2221 is fixedly attached to the rotating seat 2225, and the second gripping member 2223 is attached to the rotating seat 2225 in a way that the second gripping member 2223 can be moved close to or away from the first gripping member 2221, such that the first gripping member 2221 and the second gripping member 2223 can follow the rotating seat 2225 to rotate about the rotation axis of, so as to adjust the spatial angle of the first gripping member 2221 and the second gripping member 2223 to accurately grip the material strip starting end B21 on the standby material roll A2. The gripping drive 2226 is provided on the rotating seat 2225 and is in driving connection with the second gripping member 2223, so that the second gripping member 2223 can be driven close to or away from the first gripping member 2221, to clamp or release the material strip starting end B21. Optionally, the gripping drive 2226 can be an air cylinder.

It should be noted that in other embodiments, the first gripping member 2221 may comprise two first sub-gripping members, and the second gripping member 2223 may also comprise two second sub-gripping members forming a group with one-to-one correspondence to the two first sub-gripping members. Two groups of first sub-gripping members and the second sub-gripping members are each configured to grip two edge portions B211 of the material strip starting end B21. Wherein the two first sub-gripping members are fixedly attached to the rotating seat 2225, and the two second sub-gripping members may be attached to the rotating seat 2225 close to or away from their respective corresponding first sub-gripping members. Each first sub-gripping member has a second adsorption surface g1 on the side facing the corresponding second sub-gripping member thereto, and each second sub-gripping member has a blowing surface g2 on the side facing the corresponding first sub-gripping member thereto.

There are two gripping drives 2226, both of which are provided on the rotating seat 2225 and are in driving connection with the two second sub-clamping members respectively. That is, one of the gripping drives 2226 is configured to drive the blowing surface g2 of one of the second sub-gripping members close to or away from the second adsorption surface g1 of the corresponding first sub-gripping member, to clamp or release one of the edge portions B211. The other gripping drive 2226 is configured to drive the blowing surface g2 of the other second sub-gripping member to move close to or away from the second adsorption surface g1 of the corresponding first sub-gripping member, so as to clamp or release the other one of the edge portions B211.

Referring further to FIG. 2, in a specific embodiment, the gripping assembly 222 also includes a rotating drive 234, an active wheel 235, a driven wheel 236, and a drive belt (not shown). The rotating drive 234 is mounted on the mounting seat 221, the active wheel 235 is mounted on an output shaft of the rotating drive 234, the driven wheel 236 is mounted on the rotating seat 2225, and the drive belt is sleeved between the active wheel 235 and the driven wheel 236. In this way, when the spatial angle of the first gripping member 2221 and the second gripping member 2223 relative to the standby material roll A2 needs to be adjusted, the rotating drive 234 drives the active wheel 235 to rotate, the active wheel 235 drives the driven wheel 236 to rotate by means of the drive belt, the driven wheel 236 drives the rotating seat 2225 to rotate, and the rotating seat 2225 drives the first gripping member 2221 and the second gripping member 2223 to rotate.

In order to ensure that the pick-up mechanism 22 can accurately grip the material strip starting end B21, in one specific embodiment, the starting-end-handling device further comprises a detecting mechanism 24 which is configured to detect a position of the material strip starting end B21 on the standby material roll A2. In this way, before the automatic roll-replacement, the unwinding device can be controlled to drive the standby material roll A2 to rotate, the position of the material strip starting end B21 on the standby material roll A2 is detected by using the detecting mechanism 24. When the material strip starting end B21 is rotated to an orientation toward the pick-up mechanism 22, the unwinding device controls the standby material roll A2 to stop rotating, thereby ensuring that when the pick-up mechanism 22 moves until the first gripping member 2221 and the second gripping member 2223 are against the standby material roll A2, the material strip starting end B21 on the standby material roll A2 is located between the first gripping member 2221 and the second gripping member 2223, so as to ensure that the first gripping member 2221 and the second gripping member 2223 can accurately grip the material strip starting end B21. Optionally, the detecting mechanism 24 may use a photoelectric sensor or an image sensor.

In some embodiments, each strip-connecting mechanism 31 has a first abutting portion 310 and a second abutting portion 311 that carry tape C together. When the two strip-connecting mechanisms 31 move to a strip-connecting position, the strip-connecting mechanism 31 carrying the tape C presses the tape C (i.e. a first portion of the tape C) and the first standby material strip section B22 against one side of the support mechanism 21 by its own first abutting portion 310; and wherein the other strip-connecting mechanism 31 not carrying the tape C presses the working material strip B1 to the other side of the support mechanism 21 by its own first abutting portion 310 and presses the working material strip B1 to the tape C (i.e. a second portion of the tape C) of the strip-connecting mechanism 31 carrying the tape C by means of its own second abutting portion 311 at the downstream side of the support mechanism 21. In this way, the strip-connecting mechanism 31 carries the tape C by using the first abutting portion 310 and the second abutting portion 311 together, such that the first abutting portion 310 pastes the first portion of the tape C to the standby material strip B2 and the second abutting portion 311 pastes the second portion of the tape C to the working material strip B1, thereby enabling the strip-connecting.

In a specific embodiment, each strip-connecting mechanism 31 further comprises a cutting member 312 for cutting off the working material strip B1. The cutting member 312 is located on the side of the first abutting portion 310 facing away from the second abutting portion 311. In this way, after the strip-connecting mechanism 31 has pressed the working material strip B1 against the support mechanism 21 using the first abutting portion 310, the passing working material strip B1 is cut off by this cutting member 312, so that the working material strip B1 is separated from the empty cylinder A3.

In some embodiments, the support mechanism 21 comprises a support block 210 which can move in a controlled way along a first direction X. Both sides of the support block 210 in a second direction Y (i.e., the left and right sides in FIG. 1) have a first adsorption surface 2101 for adsorbing the standby material strip B2. The support mechanism 21 further comprises a first support roller 212 rotatably provided on one side of the support block 210 toward the avoidance position (i.e., the lower side of the support block 210 in FIG. 2). The strip-connecting mechanism 31 has an abutting roller 313 which is rotatable about its own axis (see FIG. 3).

Figure 6:
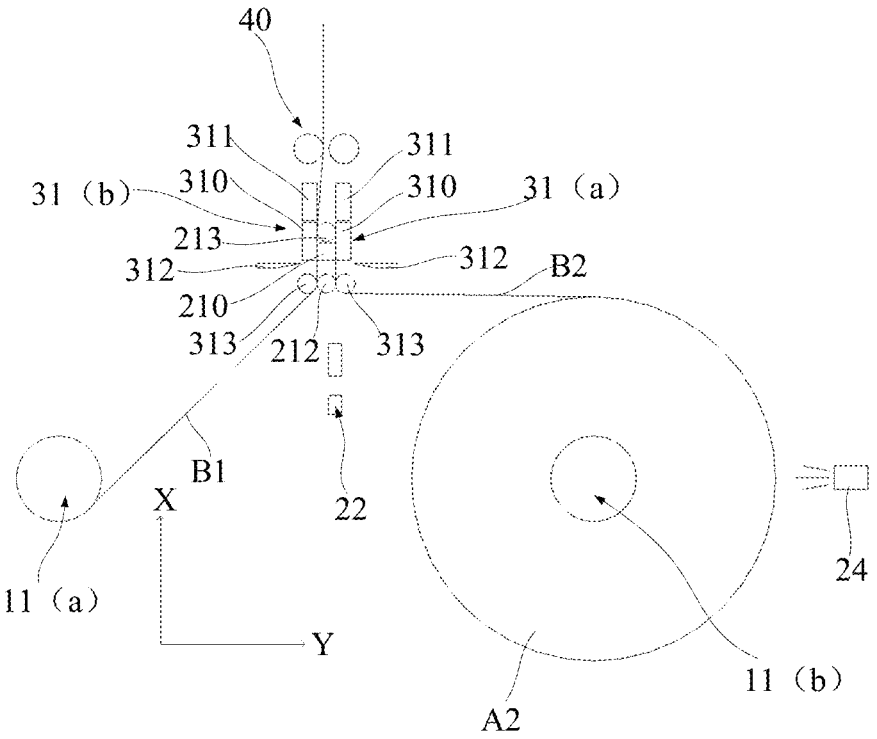
Figure 7:
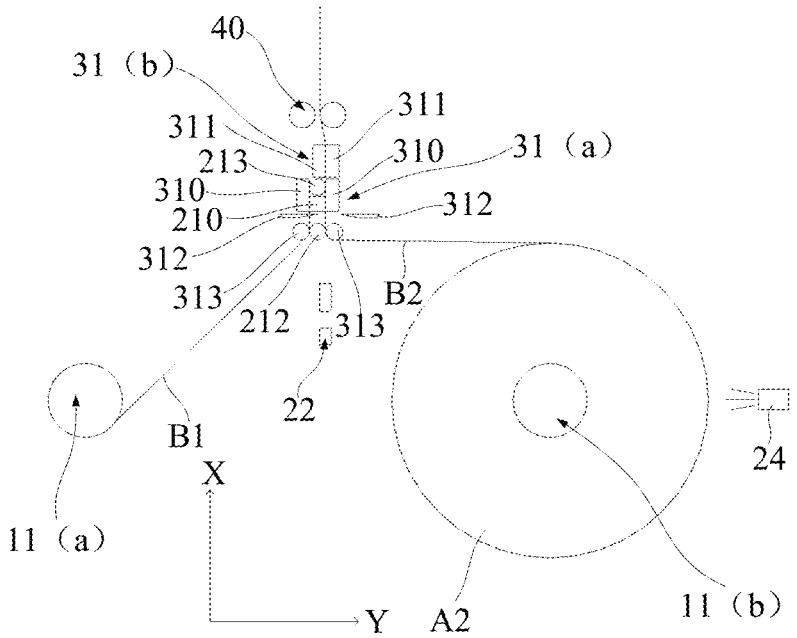

Referring to FIG. 6, when the strip-connecting mechanism 31 moves to the strip-connecting position, the abutting roller 313 on the strip-connecting mechanism 31 abuts against the first support roller 212 of the support mechanism 21 located in the strip-connecting position, thereby jointly pressing the first standby material strip section B22 or the working material strip B1 tightly. And the first abutting portions 310 of the strip-connecting mechanism 31 can be controlled to move toward the corresponding first adsorption surface 2101 to mutually abut against each other, thereby pressing the first standby material strip section B22 or the working material strip B1 against the corresponding first adsorption surface 2101.

In this way, during the roll-replacement, the strip-connecting mechanism 31 carrying the tape C moves to the strip-connecting position, so that the abutting roller 313 of the strip-connecting mechanism 31 presses the first standby material strip section B22 of the standby material strip B2 against the first support roller 212, and the first adsorption surfaces 2101 on both sides of the support block 210 adsorb the first standby material strip section B22 and the second standby material strip section B23 of the standby material strip B2, respectively, thereby preventing the standby material strip B2 wound onto and passed through the support mechanism 21 from swinging freely. At this time, the second gripping member 2223 is controlled to move away from the first gripping member 2221, thereby loosening the clamping on the material strip starting end B21. The unwinding mechanism 11 which loads the standby material roll A2 is controlled to drive the standby material roll A2 to rotate, so as to gradually wind up the standby material strip B2 until the material strip starting end B21 moves to the first adsorption surface 2101 of the support block 210 and is adsorbed. Then, the first abutting portion 310 of the strip-connecting mechanism 31 having the tape C adsorbed presses the first standby material strip section B22 and the tape C against the first adsorption surface 2101 on the side of the support block 210, causing the standby material strip B2 to be bonded to the portion of the tape C disposed on this first abutting portion 310.

Then, the strip-connecting mechanism 31 which does not adsorb tape C is controlled to move to the strip-connecting position, such that the abutting roller 313 on the strip-connecting mechanism 31 presses the working material strip B1 against the first support roller 212, and the first abutting portion 310 of the strip-connecting mechanism 31 is controlled to press the working material strip B1 and the material tape starting end B21 against the first adsorption surface 2101 on the side of the support block 210 away from the tape C. And then, the cutting member 312 of the strip-connecting mechanism 31 which does not adsorb tape C is controlled to cut off the working material strip B1, and the second abutting portion 311 of that strip-connecting mechanism 31 which does not adsorb tape C is controlled to press the working material strip B1 against the second abutting portion 311 of the strip-connecting mechanism 31 which adsorbs the tape C, so that the working material strip B1 is bonded to the portion of the tape C located on the second abutting portion 311. Finally, both strip-connecting mechanisms 31 leave the support block 210 and return to the initial position, and the support block 210 moves to the avoidance position. At this time, the strip-connecting is completed.

It should be noted that, during the roll-replacing process, before the strip-connecting mechanism 31 which does not adsorb the tape C moves to the strip-connecting position, a section of the standby material strip B2 is wound so that the material strip starting end B21 of the standby material strip B2 moves to the first adsorption surface 2101 on the side of the support block 210 away from the tape C, thereby enabling the cutting member 312 of the strip-connecting mechanism 31 which does not adsorb the tape C to be subsequently configured to cut off the working material strip B1 without cutting the material strip starting end B21 of the standby material strip B2, i.e., the waste of the standby material strip B2 is avoided.

In a specific embodiment, the support mechanism 21 further comprises a second support roller 213 rotatably mounted on the side of the support block 210 toward the strip-connecting (i.e., above the support block 210 shown in FIG. 2). In this way, when the support mechanism 21 moves from the avoidance position to the strip-connecting position, the standby material strip B2 is wound on the second support roller 213, thereby ensuring that the standby material strip B2 can be wound smoothly subsequently.

In a specific embodiment, the support mechanism 21 further comprises a lift assembly 214, and the support block 210 is mounted at a driving end of the lift assembly 214 to enable the lift assembly 214 to drive the support block 210 to move to an avoidance position or a strip-connecting position in the first direction X. The first support roller 212 and the second support roller 213 are respectively connected to both sides of the support block 210 in the first direction X in a way that the first support roller 212 and the second support roller 213 are rotatable about their own axes. The first support roller 212 is located on the side of the support block 210 toward the avoidance position (i.e., lower side of the support block 210 shown in FIG. 2), and the second support roller 213 is located on the side of the support block 210 toward the strip-connecting position (i.e., upper side of the support block 210 shown in FIG. 2). The two first adsorption surfaces 2101 are respectively located on two side of the support block 210 in the second direction Y, and both are located between the first support roller 212 and the second support roller 213. Optionally, the first adsorption surface 2101 is provided with a plurality of adsorption holes communicating to an external negative pressure source, thereby using negative pressure to achieve adsorption of the material strip. The lifting assembly 214 may employ a cylinder, an electric cylinder or a linear module, and so on.

In the embodiment of the present application, the strip-connecting device further comprises two second swing mechanisms 32 corresponding to the two strip-connecting mechanisms 31. Each of second swing mechanisms 32 comprises a second swing actuator 321 and a second swing arm 322. One end of the second swing arm 322 is connected to a driving end of the second swing actuator 321 to be driven by the second swing actuator 321 to rotate. The other end of the second swing arm 322 is connected to a corresponding strip-connecting mechanism 31, so that the strip-connecting mechanism 31 follows the second swing arm 322 to swing between the tape preparation position and the strip-connecting position. In this way, the two strip-connecting mechanisms 31 are respectively driven by the two second swing mechanisms 32 to swing between the respective tape preparation position and the strip-connecting position. When the two strip-connecting mechanisms 31 swing to the strip-connecting position, they cooperate with the support mechanism 21 to complete the strip-connecting. The two strip-connecting mechanisms 31 swing to their respective tape preparation positions to complete the tape preparation (i.e., to provide tape C for the first abutting portion 310 and the second abutting portion 311). Optionally, the second swing actuator 321 may employ an electric motor.

It should be noted that the two strip-connecting mechanisms 31 are arranged on each side of the support mechanism 21 in the second direction Y. Both strip-connecting mechanisms 31 swing towards the support mechanism 21 until they reach the strip-connecting position. The two strip-connecting mechanisms 31 swing in a direction away from each other until both reach their respective tape preparations. Obviously, the tape preparation positions of the two strip-connecting mechanisms 31 are not to be understood as being the same position, but rather as the tape preparation positions of the two strip-connecting mechanisms 31 being two different positions.

In a specific embodiment, each strip-connecting mechanism 31 includes a first driving member 314, a moving block 315, a second driving member 316, a first abutting portion 310, a second abutting portion 311, a third driving member 317, and a cutting member 312. The first driving member 314 is mounted on the second swing arm 322, and the moving block 315 is provided at a driving end of the first driving member 314, such that the first driving member 314 can drive the moving block 315 to move. The second driving member 316, the first abutting portion 310 and the third driving member 317 are all mounted on the moving block 315, such that the second driving member 316, the first abutting portion 310 and the third driving member 317 follow the moving block 315 to move together. The second abutting portion 311 is provided at a driving end of the second driving member 316, such that the second driving member 316 can drive the second abutting portion 311 to move. The cutting member 312 is provided at a driving end of the third driving member 317 to enable the third driving member 317 to drive the cutting member 312 to move, thereby completing the cutting action.

When the second swing arm 322 drives the strip-connecting mechanism 31 to swing to the strip-connecting position, the first driving member 314 drives the moving block 315 to extend along the second direction Y to drive the first abutting portion 310 to press the material strip (working material strip B1 or standby material strip B2) to one side of the support mechanism 21, the third driving member 317 can drive the cutting member 312 to cut off the working material strip B1 from the upstream side of the support mechanism 21, and the second driving member 316 can drive the second abutting portion 311 to extend along the second direction Y to press the working material strip B1 at the downstream side of the support mechanism 21 against the opposite side of the support mechanism 21 until the working material strip B1 is bonded to the tape C. Optionally, the first driving member 314, the second driving member 316 and the third driving member 317 may all use cylinders. Both the first abutting portion 310 and the second abutting portion 311 may employ an abutting block, and the cutting member 312 may employ a cutter.

Figure 27:
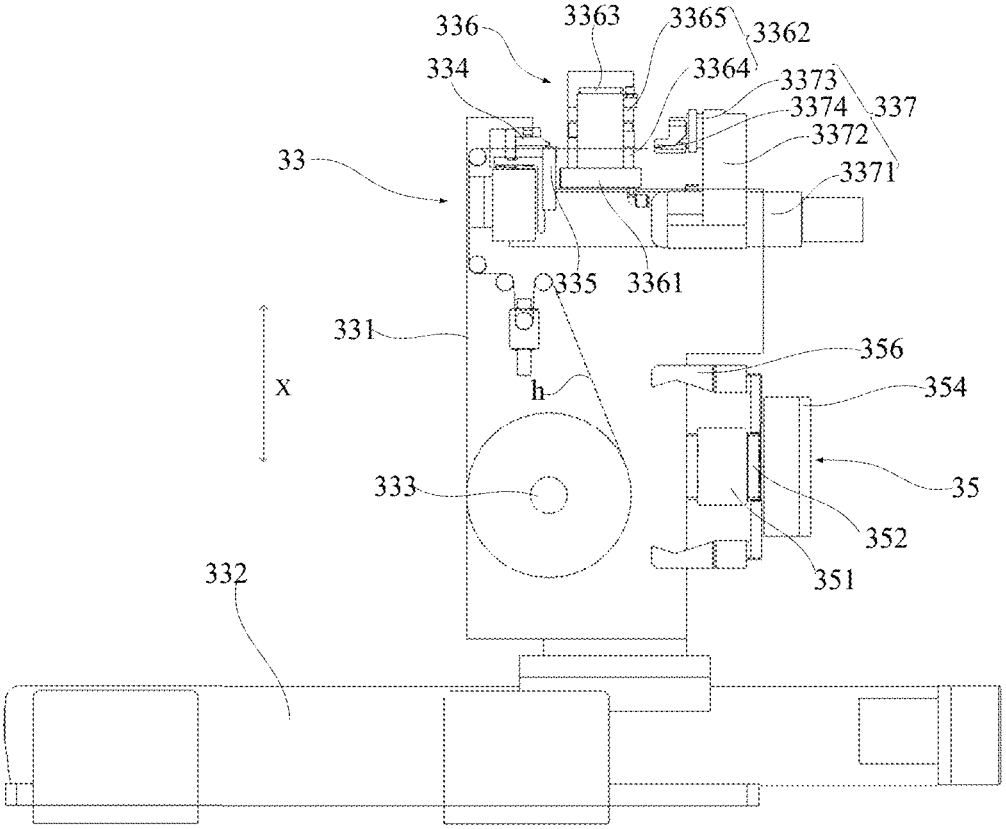
FIG. 27 a schematic diagram of the structure of the tape preparation mechanism in an embodiment of the present application.
Figure 28:
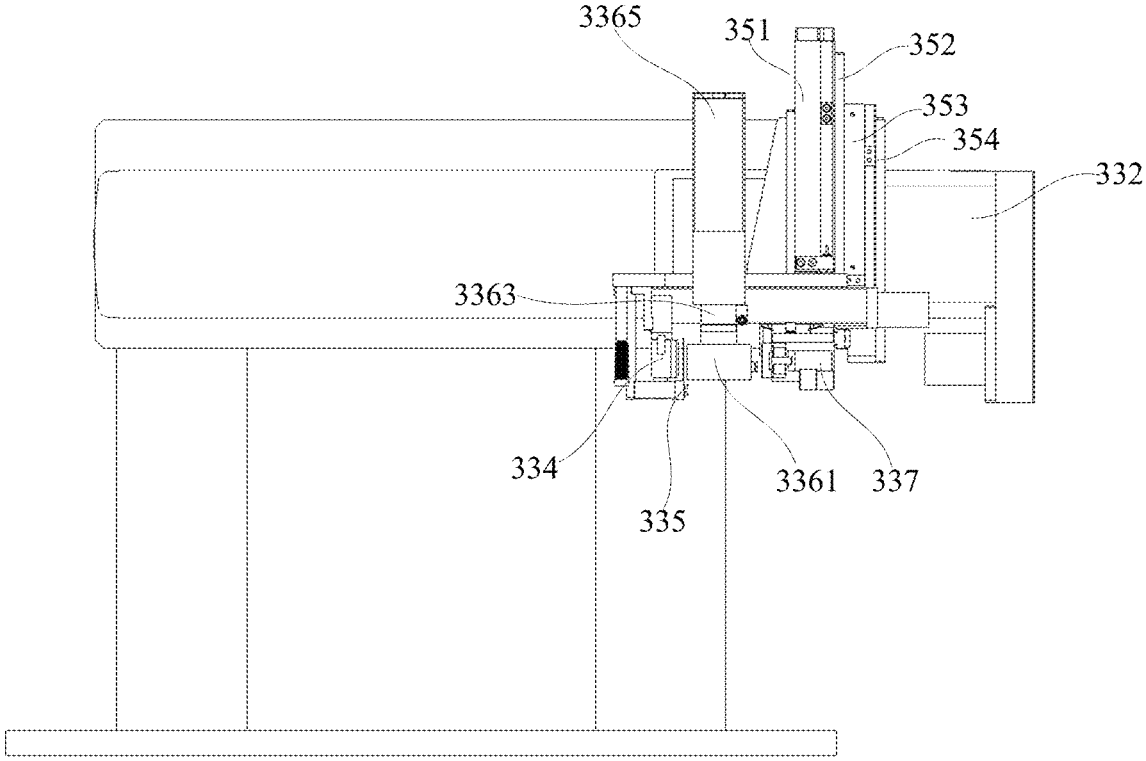
FIG. 28 shows a top view of the tape preparation mechanism shown in FIG. 27.

Referring to FIGS. 27 and 28, in a specific embodiment, a strip-connecting device further comprises a tape preparation mechanism 33, which is configured to prepare tape for the strip-connecting mechanism 31 swinging to a tape preparation position (i.e., the tape C is adsorbed on the first abutting portion 310 and the second abutting portion 311). The tape preparation mechanism 33 comprises a moving seat 331 and a tape supplying assembly 336 provided on the moving seat 331. The tape supplying assembly 336 has a tape supplying sucker 3361 for adsorbing tape C, and the tape supplying sucker 3361 can move in a controlled way in a first predetermined direction. The moving seat 331 can move in a controlled way to a tape preparation position of each of the strip-connecting mechanisms 31. When the moving seat 331 moves to a tape preparation position of any one of the strip-connecting mechanisms 31, the tape supplying sucker 3361 is disposed in the first predetermined direction opposite to the first abutting portion 310 and the second abutting portion 311 of the strip-connecting mechanism 31 moving to that tape preparation position, such that the tape supplying sucker 3361 can move in the first predetermined direction towards the first abutting portion 310 and the second abutting portion 311 until the first abutting portion 310 and the second abutting portion 311 suck the tape C on the tape supplying sucker 3361. Optionally, this first predetermined direction is parallel to the first direction X.

Further, both the first abutting portion 310 and the second abutting portion 311 have a third adsorption surface d1. When the second driving member 316 drives the second abutment 311 to retract, the third adsorption surfaces d1 of the first abutting portion 310 is level with the third adsorption surfaces d1 of the second abutting portion 311 to form a tape-adsorbing surface d together, so that the tape-adsorbing surface d can be configured to adsorb the tape C on the tape supplying sucker 3361. When the second swing arm 322 drives the strip-connecting mechanism 31 to swing to the tape preparation position, the two third adsorption surfaces d1 of the first abutting portion 310 and the second abutting portion 311 have the same level to form a tape-adsorbing surface d together, and the tape-adsorbing surface d is opposite in the first predetermined direction to the tape supplying sucker 3361 moving to this tape preparation position, so that the tape supplying sucker 3361 can move in the first predetermined direction toward the first abutting portion 310 and the second abutting portion 311 until the tape-adsorbing surface d adsorbs the tape C on the tape supplying sucker 3361.

In a specific embodiment, the tape preparation mechanism 33 further includes a tape-unwinding assembly 333, a tape-clamping assembly 334, a tape-cutting assembly 335, and a tape-pulling assembly 337 mounted on the moving seat 331.

The tape-unwinding assembly 333 is configured to unwind and output tape material strip h to the tape-clamping assembly 334, which can controllably clamp or release the passing tape material strip h. The tape supplying sucker 3361 is located on downstream side of the tape-clamping assembly 334 and is configured to adsorb the passing tape material strip h. The tape-pulling assembly 337 is constructed to controllably clamp the tape material strip h passing through the tape-clamping assembly 334, and to pull the tape material strip h to one side of the tape supplying sucker 3361 away from the tape-clamping assembly 334. A tape-cutting assembly 335 is disposed between the tape-clamping assembly 334 and the tape supplying sucker 3361 for cutting off the passing tape material strip h.

In this way, when the tape supplying sucker 3361 requires tape C, first, a head of the tape material strip h is clamped by the tape-clamping assembly 334, and the tape-pulling assembly 337 is controlled to move toward the tape-clamping assembly 334 until the head of the tape material strip h on the tape-clamping assembly 334 is gripped. The tape-clamping assembly 334 then releases the tape material strip h, and the tape-pulling assembly 337 pulls the tape material strip h through the tape supplying sucker 3361 until it reaches the side of the tape supplying sucker 3361 away from the tape-clamping assembly 334. Then, the tape-clamping assembly 334 clamps the tape material strip h, the tape supplying sucker 3361 adsorbs and fixes the passing tape material strip h, and the tape-cutting assembly 335 is controlled to cut the tape material strip h between the tape-clamping assembly 334 and the tape supplying sucker 3361, and the tape-pulling assembly 337 releases it. At this time, the portion that is adsorbed to the tape supplying sucker 3361 is the tape C.

In a specific embodiment, the tape supplying assembly 336 further includes a tape supply driving part 3362 mounted on the moving seat 331 and a tape supply actuator 3363 mounted at a driving end of the tape supply driving part 3362. The tape supply driving part 3362 is configured to drive the tape supply actuator 3363 to move in a second predetermined direction intersecting the first predetermined direction. The tape supply actuator 3363 is in driving connection with the tape supplying sucker 3361, to drive the tape supplying sucker 3361 to move in the first predetermined direction. In this way, when it is necessary to supply tape C to the strip-connecting mechanism 31 that has moved to the tape preparation position, first, the moving seat 331 moves to the tape preparation position, and the tape supply actuator 3363 and the tape supplying sucker 3361 are driven by the tape supply driving part 3362 in the second predetermined direction until the tape supplying sucker 3361 is opposite to the first abutting portion 310 and the second abutting portion 311 of the strip-connecting mechanism 31 in the first predetermined direction. Then, the tape supplying sucker 3361 is driven by the tape supply actuator 3363 to move in the first predetermined direction until the tape C is conveyed to the first abutting portion 310 and the second abutting portion 311 of the strip-connecting mechanism 31. Optionally, the tape supply actuator 3363 may employ a cylinder.

In a specific embodiment shown in FIG. 27, the first predetermined direction is up and down direction, and the second predetermined direction is perpendicular to a paper surface direction.

Optionally, the tape supply driving part 3362 comprises a first movement-actuator 3364 and a second movement-actuator 3365. The first movement-actuator 3364 is mounted in the moving seat 331 and the second movement-actuator 3365 is provided at a driving end of the first movement-actuator 3364 to be driven by the first movement-actuator 3364 to move in the second predetermined direction. The tape supply actuator 3363 is provided at one driving end of the second movement-actuator 3365 to be driven by the second movement-actuator 3365 to move in the second predetermined direction. In this way, by both the first movement-actuator 3364 and the second movement-actuator 3365 driving the tape supply actuator 3363 and the tape supplying sucker 3361 to move in the second predetermined direction, on the one hand a running distance of the tape supplying sucker 3361 is ensured to meet the demand; on the other hand, compared to using a driving member with a large running distance, in the embodiment two actuators with smaller running distances are used instead of a driving member with a large running distance. It is advantageous to save the space required to be occupied, improving compactness of the structure. Optionally, both the first movement-actuator 3364 and the second movement-actuator 3365 may use a cylinder.

It should be noted that, of course, in other embodiments, the tape supply driving part 3362 may also be provided with only one actuator, or with three or more actuators, as long as it can drive the tape supplying sucker 3361 to move in the second predetermined direction and meet the requirements of the running distance, without any limitation herein.

In specific embodiments, the tape-clamping assembly 334 includes a jaw cylinder mounted on the moving seat 331 and jaws mounted on a driving end of the jaw cylinder. The jaw cylinder drives the jaws to clamp or release the passing tape material strip h. Of course, other types of clamping structures may be used in other embodiments, as long as the passing tape material strip h can be clamped, which is not limited here.

In specific embodiments, the tape-cutting assembly 335 includes a tape-cutting cylinder mounted on the moving seat 331 and a tape-cutting knife mounted on a driving end of the tape-cutting cylinder. The tape-cutting cylinder drives the tape-cutting knife to cut off the passing tape material strip h. Of course, other types of cutting structures may be used in other embodiments, as long as the passing tape material strip h can be cut off, which is not limited here.

In a specific embodiment, the tape-pulling assembly 337 includes a tape-pulling driving member 3371, a tape-pulling slide 3372, a tape-pulling jaw cylinder 3373, and a tape-pulling jaw 3374. The tape-pulling driving member 3371 is mounted on the moving seat 331. The tape-pulling slide 3372 is mounted on a driving end of the tape-pulling driving member 3371, such that the tape-pulling driving member 3371 can drive the tape-pulling slide 3372 to move. The tape-pulling jaw cylinder 3373 is mounted on the tape-pulling slide 3372 to move with the tape-pulling slide 3372. The tape-pulling jaw 3374 is mounted on a driving end of the tape-pulling jaw cylinder 3373 such that the tape-pulling jaw cylinder 3373 can drive the tape-pulling jaw 3374 to clamp or release the tape material strip h. In this way, when the tape material strip h needs to be pulled out, first, the tape-pulling driving member 3371 drives the tape-pulling slide 3372 to move close to the tape-clamping assembly 334 until the tape-pulling jaw cylinder 3373 can drive the tape-pulling jaw 3374 to clamp the tape material strip h. Then, the tape-clamping assembly 334 releases the tape material strip h, and the tape-pulling driving member 3371 drives the tape-pulling slide 3372 away from the tape-clamping assembly 334 until it reaches the side of the tape supplying sucker 3361 away from the tape-clamping assembly 334, and the tape-pulling is completed.

It should be noted that the tape-pulling driving member 3371 may use a linear drive module such as a motor screw module or an electric cylinder in the prior art, for example, which is not limited here.

In some embodiments, the strip-connecting device further comprises a cylinder conveying mechanism 35 and a cylinder collecting mechanism 34 (see FIG. 1). The cylinder conveying mechanism 35 is mounted on the moving seat 331. The cylinder collecting mechanism 34 is arranged in a first position, and the unwinding device comprises two unwinding mechanisms 11 arranged in a second and a third position respectively.

The moving seat 331 can be controlled to move between the first position, the second position and the third position. When the moving seat 331 is moved to the second position or the third position, the cylinder conveying mechanism 35 grips the empty cylinder A3 on the corresponding unwinding mechanism 11. When the moving seat 331 is moved to the first position, the cylinder conveying mechanism 35 transfers the gripped empty cylinder A3 to the cylinder collection mechanism 34. In this way, the empty cylinder A3 on the unwinding mechanism 11 is automatically transported to the cylinder collecting mechanism 34 for collection, which further reduces the labor costs and improves automation.

In a specific embodiment, the cylinder conveying mechanism 35 comprises a conveying drive assembly and a clamping assembly 356. The conveying drive assembly is mounted on the moving seat 331, and the clamping assembly 356 is mounted on a driving end of the conveying drive assembly to be driven by the conveying drive assembly to move axially along the unwinding shaft of the unwinding mechanism 11. The clamping assembly 356 is configured to clamp or release the empty cylinder A3. In this way, when the moving seat 331 is moved to the second or third position, the conveying drive assembly drives the clamping assembly 356 close to the empty cylinder A3 on the unwinding shaft of the unwinding mechanism 11 until the clamping assembly 356 clamps the empty cylinder A3. Then, the conveying drive assembly drives the clamping assembly 356 to move axially along the unwinding shaft until the clamping assembly 356 drives the empty cylinder A3 off the unwinding shaft of the unwinding mechanism 11. Then, the moving seat 331 moves to the first position, and the conveying drive assembly drives the clamping assembly 356 to move toward the cylinder collecting mechanism 34 until the empty cylinder A3 is placed on the cylinder collecting mechanism 34. Then, the clamping assembly 356 releases the empty cylinder A3, and is driven by the conveying drive assembly to move away from the cylinder collecting mechanism 34 to prepare the next conveying of the empty cylinder A3.

Optionally, the conveying drive assembly comprises a first conveying drive 351, a first drive plate 352, a second conveying drive 353, and a second drive plate 354. The first conveying drive 351 is mounted on the moving seat 331, and the first drive plate 352 is mounted on a driving end of the first conveying drive 351 so that the first conveying drive 351 can drive the first drive plate 352 to move axially along the unwinding shaft of the unwinding mechanism 11. A second conveying drive 353 is mounted on the first drive plate 352 to move with the first drive plate 352. The second drive plate 354 is mounted to a driving end of the second conveying drive 353 so that the second conveying drive 353 can drive the second drive plate 354 to move axially along the unwinding shaft of the unwinding mechanism 11. The clamping assembly 356 is mounted on the second drive plate 354 so that the clamping assembly 356 can move along with the second drive plate 354.

In this way, when the moving seat 331 is moved to the second position or the third position, the first conveying drive 351 or the second conveying drive 353 drives the clamping assembly 356 close to the empty cylinder A3 on the unwinding shaft of the unwinding mechanism 11 until the clamping assembly 356 clamps the empty cylinder A3. Then, the first conveying drive 351 or the second conveying drive 353 drives the clamping assembly 356 to move axially along the unwinding shaft of the unwinding mechanism 11 until the clamping assembly 356 drives the empty cylinder A3 off the unwinding shaft of the unwinding mechanism 11. Then, the moving seat 331 is moved to the first position, and the first conveying drive 351 and the second conveying drive 353 drive the clamping assembly 356 to move toward the cylinder collecting mechanism 34 until the empty cylinder A3 is placed on the cylinder collecting mechanism 34. Then, the clamping assembly 356 releases the empty cylinder A3, and is driven by the first conveying drive 351 and the second conveying drive 353 to move away from the cylinder collecting mechanism 34 to prepare the next conveying of the empty cylinder. Optionally, both the first conveying drive 351 and the second conveying drive 353 may be pneumatic cylinders. The clamping assembly 356 may be a pneumatic or electric jaw; etc., as long as it can clamp and release the empty cylinder A3, which is not limited here.

Of course, it is not limited to using two conveying drives to form a two-stage driving to the clamping assembly 356. In other embodiments, only one conveying drive may be provided to drive the clamping assembly 356 to move (i.e., a one-stage driving). In yet other embodiments, three or more conveying drives may also be provided, which is not limited here.

In a specific embodiment, the tape preparation mechanism 33 further comprises a movement drive assembly 332. The movement drive assembly 332 is in driving connection with the moving seat 331 to drive the moving seat 331 to move in the second direction Y, such that the moving seat 331 passes through the first position, the second position, the third position and the respective tape preparation positions of the two strip-connecting mechanisms 31. It is understood that when the moving seat 331 is moved to the first position, the cylinder conveying mechanism 35 places the empty cylinder A3 on the cylinder collecting mechanism 34; when the moving seat 331 is moved to the second or third position, the cylinder conveying mechanism 35 removes the empty cylinder A3 from the unwinding shaft of the corresponding unwinding mechanism 11; when the moving seat 331 is moved to the tape preparation position of one of the strip-connecting mechanisms 31, the tape preparation mechanism 33 prepares the tape on the tape-adsorbing surfaces d of the first abutting portion 310 and the second abutting 311 of the strip-connecting mechanism 31; and when the moving seat 331 is moved to the tape preparation position of the other strip-connecting mechanism 31, the tape preparation mechanism 33 prepares the tape on the tape-adsorbing surfaces d of the first abutting portion 310 and the second abutting 311 of this strip-connecting mechanism 31.

It should be noted that the movement drive assembly 332 may be a linear drive module such as a motor screw module or an electric cylinder in the prior art, for example, which is not limited here.

Figure 29:
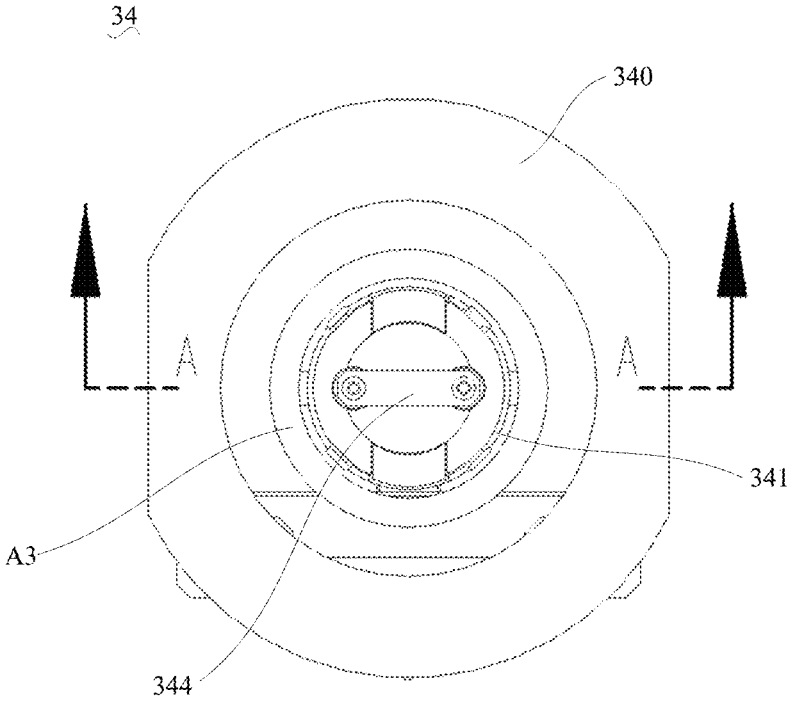
FIG. 29 a schematic diagram of the structure of the cylinder collecting mechanism in an embodiment of the present application.
Figure 30:
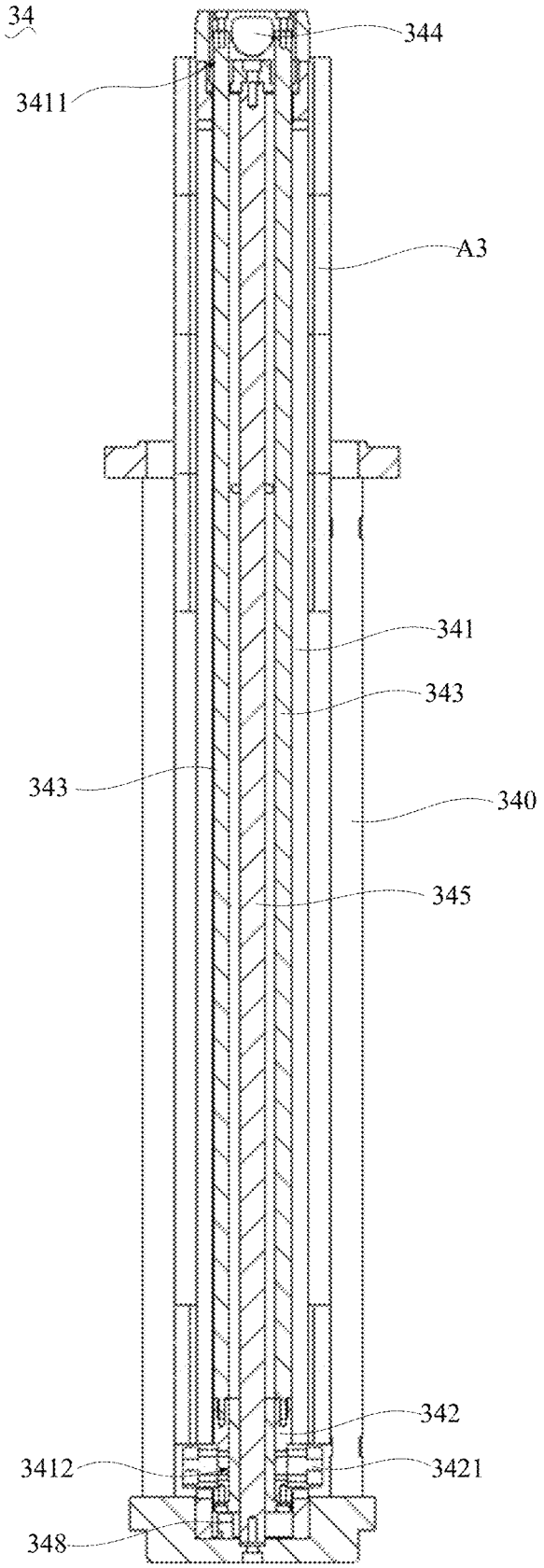
FIG. 30 is a sectional view of the cylinder collecting mechanism shown in FIG. 29 along the A-A direction.
Figure 31:
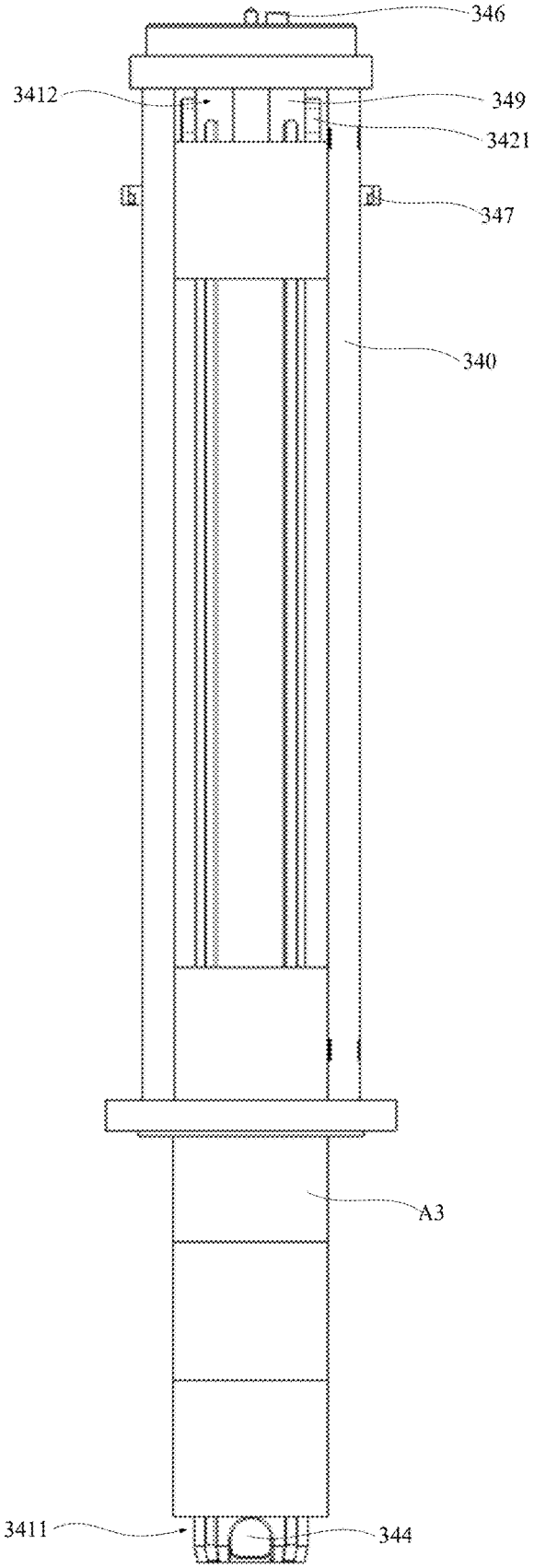
FIG. 31 shows a top view of the cylinder collecting mechanism shown in Figure.

Referring to FIG. 29 to FIG. 31, in some embodiments, the cylinder collecting mechanism 34 includes a connecting seat 340 and a material-winding shaft 341. The material-winding shaft 341 is connected to the connecting seat 340, and has a fixed end 3412 and a material-winding end 3411 as its longitudinal ends. When the cylinder conveying mechanism 35 moves to the first position, the empty cylinder A3 clamped by the clamping assembly 356 is aligned with the material-winding end 3411 of the material-winding shaft 341, such that the first conveying drive 351 and the second conveying drive may drive the clamping assembly 356 to move axially along the material-winding shaft 341 toward the material-winding shaft 341 and the empty cylinder A3 can be sleeved on the material-winding shaft 341. When the empty cylinder A3 is moved into place along the material-winding shaft 341, the clamping assembly 356 releases the empty cylinder A3 and returns under the drive of the first conveying drive 351 and the second conveying drive.

In a specific embodiment, when the moving seat 331 is moved to the second position or the third position, first, the first conveying drive 351 or the second conveying drive 353 drives the clamping assembly 356 close to the empty cylinder A3 on the unwinding shaft of the unwinding mechanism 11 until the clamping assembly 356 clamps the empty cylinder A3. Then, the first conveying drive 351 or the second conveying drive 353 drives the clamping assembly 356 move axially along the unwinding shaft until the clamping assembly 356 drives the empty cylinder A3 off the unwinding shaft of the unwinding mechanism 11.

When the cylinder conveying mechanism 35 moves to the first position, first, the first conveying drive 351 and the second conveying drive 353 drive the clamping assembly 356 to move axially along the material-winding shaft 341 toward the material-winding shaft 341, so that the empty cylinder A3 clamped by the clamping assembly 356 is sleeved onto the material-winding shaft 341 from the material-winding end 3411 of the material-winding shaft 341. The clamping assembly 356 then releases the empty cylinder A3, and the first conveying drive 351 and the second conveying drive 353 drive the clamping assembly 356 to return until it is disengaged from the material-winding end 3411 of the material-winding shaft 341 for the next conveying of the empty cylinder A3.

It should be noted that the running distance of the clamping assembly 356 is different when clamping the empty cylinder A3 in the second position or the third position from when releasing the empty cylinder A3 in the first position, so the first conveying drive 351 and the second conveying drive 353 are provided to meet the requirements for the different running distances. That is, in the second position or the third position the required running distance of the clamping assembly 356 is satisfied by the first conveying drive 351 or the second conveying drive 353, and in the first position the required running distance of the clamping assembly 356 is satisfied by the first conveying drive 351 and the second conveying drive 353 together.

In a specific embodiment, the cylinder collecting mechanism 34 further comprises a sliding sleeve 342, a connecting rod 343 and a puller 344. The material-winding shaft 341 is a hollow shaft and is provided with a sliding groove extending axially along its longitudinal length. The sliding sleeve 342 is provided within the material-winding shaft 341, and is movable along the axial direction of the material-winding shaft 341. The sliding sleeve 342 has a material-pushing portion 3421 which extends from the sliding groove to a circumferential surface of the material-winding shaft 341, so that when the sliding sleeve 342 moves from the fixed end 3412 of the material-winding shaft 341 to the material-winding end 3411, the material-pushing portion 3421 can push the empty cylinder A3 on the material-winding shaft 341 toward the material-winding end 3411 until each empty cylinder A3 is sequentially unloaded from the material-winding end 3411. The connecting rod 343 is provided in the material-winding shaft 341. One end of the connecting rod 343 is connected to the sliding sleeve 342, and the other end of the connecting rod 343 extends to the material-winding end 3411 and is connected to the puller 344.

In this way, when the empty cylinder A3 on the material-winding shaft 341 is full, it is necessary to unload the empty cylinder A3 on the material-winding shaft 341. First, the puller 344 is pulled, so that the connecting rod 343 drives the sliding sleeve 342 to move toward the material-winding end 3411, and the material-pushing portion 3421 of the sliding sleeve 342 pushes the individual empty cylinders A3 on the material-winding shaft 341 to move toward the material-winding end 3411 until the individual empty cylinders A3 on the material-winding shaft 341 is discharged from the material-winding end 3411 sequentially, that is, the unloading is completed.

Further, the cylinder collecting mechanism 34 further comprises a guide rod 345 provided within the material-winding shaft 341. The ends of the guide rod 345 are connected to the material-winding end 3411 and the fixed end 3412, respectively. The sliding sleeve 342 is sleeved on the guide rod 345, thereby guiding the axial movement of the sliding sleeve 342 along the material-winding shaft 341 using the guide rod 345.

Further, the cylinder collecting mechanism 34 further comprises a first sensor 346 and a detection bar 348. The first sensor 346 is mounted on the connecting seat 340, and the detection bar 348 is mounted on the sliding sleeve 342. When the sliding sleeve 342 moves to the fixed end 3412, the first sensor 346 is capable of detecting the detection bar 348. In this way, when the first sensor 346 detects the detection bar 348, it indicates that the sliding sleeve 342 has moved to the fixed end 3412, at which time the material-winding shaft 341 can receive an empty cylinder A3 conveyed by the cylinder conveying mechanism 35. Optionally, the first sensor 346 may be a photoelectric sensor or a proximity sensor.

Further, the cylinder collecting mechanism 34 further comprises a second sensor 347 mounted on the connecting seat 340. The second sensor 347 can detect an empty cylinder A3 moved to the fixed end 3412. In this way, when the second sensor 347 detects an empty cylinder A3 moved to the fixed end 3412, it indicates that the empty cylinder A3 on the material-winding shaft 341 is full and the puller 344 needs to be pulled to unload the empty cylinder A3. Optionally, the second sensor 347 may be a photoelectric sensor.

Further, the cylinder collecting mechanism 34 further comprises a material-stopping block 349 mounted at the fixed end 3412 of the material-winding shaft 341. The empty cylinder A3 moved to the fixed end 3412 is stopped and limited by the material-stopping block 349.

Figure 32:
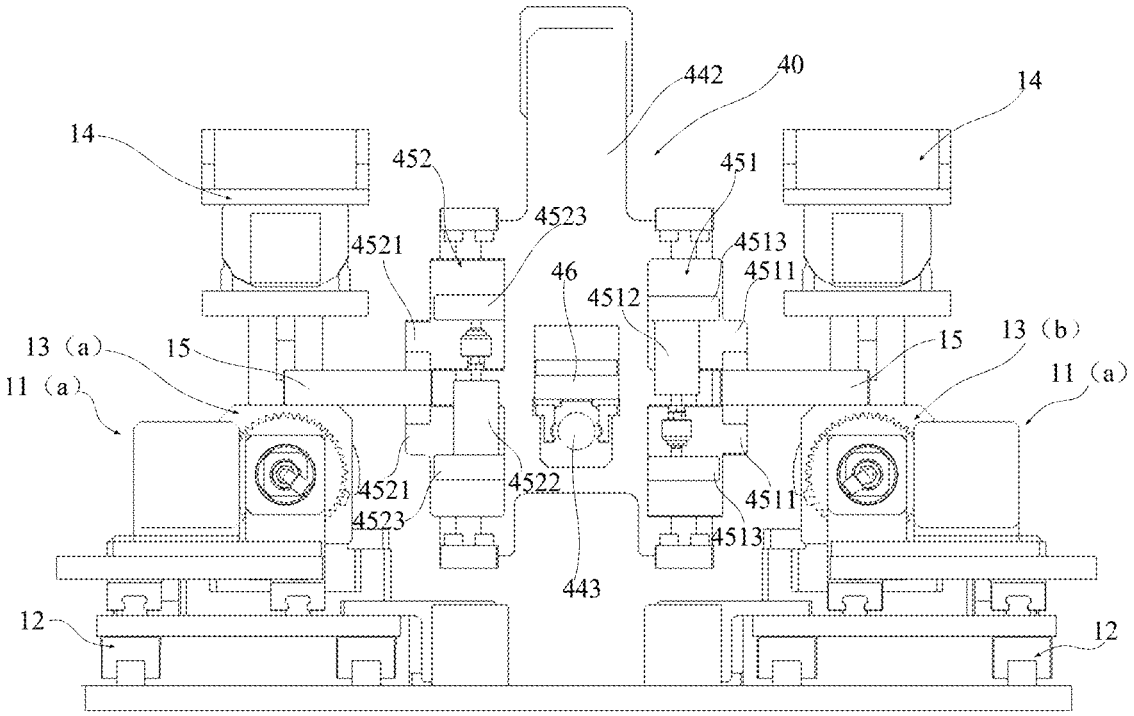
FIG. 32 a schematic diagram of the structure of an unwinding device and a guide device in an embodiment of the present application.
Figure 33:
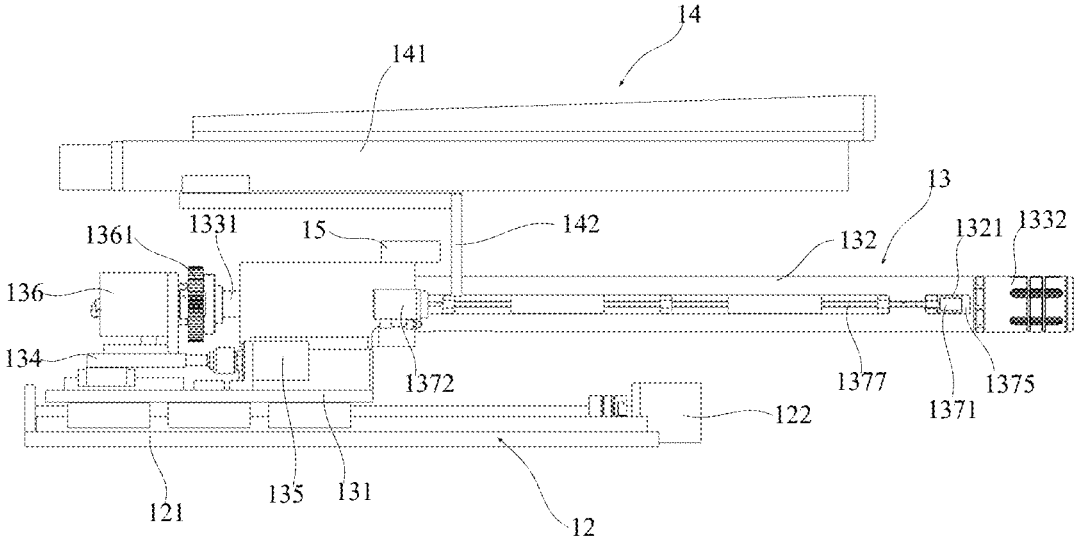
FIG. 33 shows a side view of the unwinding device shown in FIG. 32.

Referring to FIG. 32 to FIG. 33, in an embodiment of the present application, each unwinding mechanism 11 includes an unwinding assembly 13 and a material-prodding assembly 14. The unwinding assembly 13 includes a carrier seat 131, a carrier shaft 132, and an unwinding shaft. The carrier shaft 132 is mounted on the carrier seat 131. The unwinding shaft is coaxially provided on the carrier shaft 132, and has a mounting section 1331 and an unwinding section 1332. The unwinding shaft is rotatable about its own axis and axially movable relative to the carrier shaft 132. During the axial movement of the unwinding shaft relative to the carrier shaft 132, the unwinding section 1332 can be driven to axially dock with the carrier shaft 132 or separate from the carrier shaft 132. Wherein, the carrier shaft 132 is configured to carry one or more standby material rolls A2 along the axial direction. The material-prodding assembly 14 is configured to prod the standby material rolls A2 on the carrier shaft 132 toward the unwinding section 1332 until the foremost standby material roll A2 is prodded onto the unwinding section 1332.

In this way, when the cylinder conveying mechanism 35 carries away the empty cylinder A3 on the unwinding section 1332 of the unwinding shaft, the material-prodding assembly 14 prods a standby material roll A2 on the carrying shaft 132 to the unwinding section 1332 of the unwinding shaft. After the automatic roll-replacement is completed, this standby material roll A2 on the unwinding section 1332 is switched to a working material roll A1 and rotates under the drive of the unwinding shaft, so as to realize the downstream unwinding and output of a working material strip B1.

In a specific embodiment, the unwinding mechanism 11 further includes an unwinding drive assembly provided on the carrier seat 131. The carrier shaft 132 is a hollow shaft, the unwinding shaft is passed into the carrier shaft 132. The unwinding section 1332 is passed out from one end of the carrier shaft 132. One end of the mounting section 1331 away from the unwinding section 1332 is in driving connection with the unwinding drive assembly, so that the unwinding drive assembly can drive the unwinding shaft to move in the axial direction or rotate about its own axis. In this way, when it is necessary to prod the standby material roll A2 onto the unwinding section 1332 of the unwinding shaft, the unwinding drive assembly drives the unwinding shaft to move axially until the unwinding section 1332 is axially docked with the carrying shaft 132. Then, the standby material roll A2 on the carrier shaft 132 is prodded onto the unwinding section 1332 by using the material-prodding assembly 14. And then, the unwinding drive assembly drives the unwinding shaft to move backwards in the axial direction, causing the unwinding section 1332 to separate from the carrier shaft 132, thereby avoiding the carrier shaft 132 from adversely influencing the unwinding process of the unwinding shaft. When unwinding is required, the unwinding drive assembly drives the unwinding shaft to rotate, thereby driving the working material roll A1 on the unwinding section 1332 to rotate to achieve unwinding.

In a specific embodiment, the unwinding drive assembly includes a separating seat 134, an unwinding-actuator 136, and a separation driving member 135. The separating seat 134 is movably connected to the carrier seat 131 along the axial direction of the carrier shaft 132. The unwinding-actuator 136 is mounted on the separating seat 134, and is in driving connection with the mounting segment 1331 to drive the unwinding shaft to rotate. The separation driving member 135 is mounted on the carrier seat 131, and is in driving connection with the separating seat 134 to drive the separating seat 134 to move along an axial direction of the carrier shaft 132, so as to drive the unwinding-actuator 136 and the unwinding shaft to move along an axial direction of the unwinding shaft to achieve axial docking and separation of the unwinding section 1332 of the unwinding shaft and the carrier shaft 132. Optionally, the unwinding-actuator 136 may be a motor and the separation driving member 135 may be a cylinder.

Optionally, the unwinding drive assembly further comprises an active gear 1361 and a driven gear. The active gear 1361 is mounted at a driving end of the unwinding-actuator 136, and the driven gear is mounted at the mounting section 1331 of the unwinding shaft and engaged with the active gear 1361. In this way, the unwinding-actuator 136 drives the active gear 1361 to rotate, the active gear 1361 drives the driven gear to rotate, and the driven gear drives the unwinding shaft to rotate, thereby achieving unwinding.

Optionally, a slide rail and a slider structure may be provided between the carrier seat 131 and the separating seat 134, and the movement of the separating seat 134 relative to the carrier seat 131 is guided using the slide rail and the slider structure.

In some embodiments, the unwinding assembly 13 further includes a stop structure that includes a stop block 1371. A circumferential side of the carrier shaft 132 near an end of the unwinding section 1332 has a mounting slot 1321. The stop block 1371 is provided within the mounting slot 1321 and can be controlled to move along a radial direction of the carrier shaft 132 to a stop position and a loading position. When the stop block 1371 is in the stop position, the stop block 1371 protrudes from the circumferential side of the carrier shaft 132 to block movement of the standby material roll A2 on the carrier shaft 132 toward the unwinding section 1332. When the stop block 1371 is in the loading position, the stop block 1371 retracts into the carrier shaft 132 to allow the standby material roll A2 on the carrier shaft 132 to move toward the unwinding section 1332.

Figure 34:
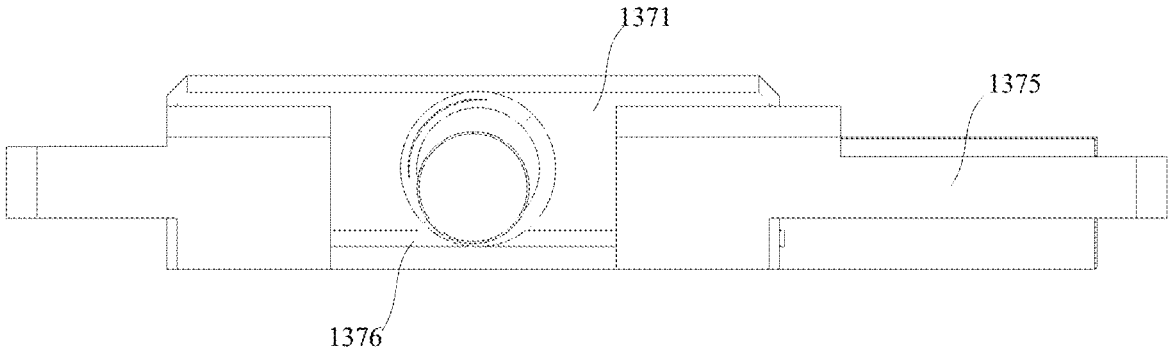
FIG. 34 shows an assembling structure of a stop block on a carrier shaft of the unwinding device shown in FIG. 33.
Figure 35:
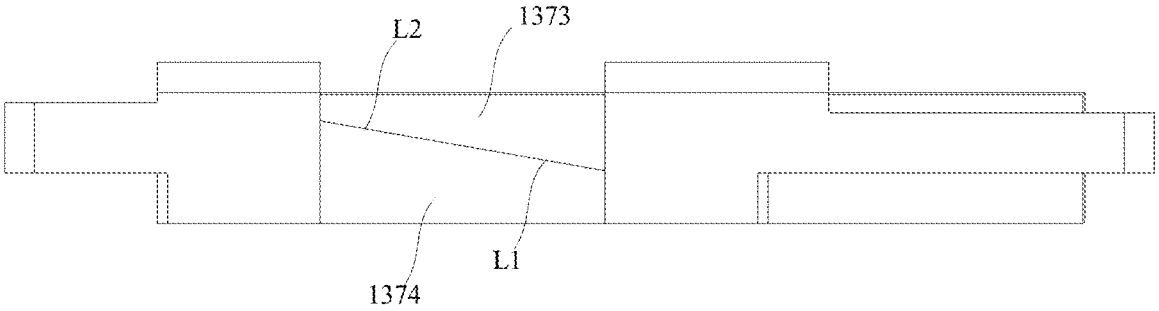
FIG. 35 shows an assembling structure of a first wedge block and a second wedge block on the carrier shaft of the unwinding device shown in FIG. 33.

Referring to FIG. 34 to FIG. 35, in a specific embodiment, the stop structure further comprises a first wedge block 1374, a second wedge block 1373 and a stop actuator 1372 (see FIG. 33). The first wedge block 1374 is mounted in the mounting slot 1321 of the carrier shaft 132, and has a first inclined surface L1 inclined axially relative to the carrier shaft 132. The second wedge block 1373 slidingly fits the first inclined surface L1, and abuts the stop block 1371 along the radial direction of the carrier shaft 132 so that the second wedge block 1373 moves axially along the carrier shaft 132 while being guided by the first inclined surface L1 moves along the radial direction of the carrier shaft 132, which in turn drives the stop block 1371 to move along the radial direction of the carrier shaft 132, i.e., to realize movement of the stop block 1371 between the stop position and the loading position.

The stop actuator 1372 is mounted on the carrier seat 131 or the carrier shaft 132. The stop actuator 1372 is in driving connection with the second wedge block 1373 to drive the second wedge block 1373 to move along the axial direction of the carrier shaft 132, to realize movement of the stop block 1371 between the stop position and the loading position. In this way, the sliding fit of the second wedge block 1373 with the first inclined surface L1 of the first wedge block 1374 is configured to convert the axial movement of the second wedge block 1373 along the carrier shaft 132 into the movement of the stop block 1371 along the radial direction of the carrier shaft 132. The structure is simple, and the switching of the stop block 1371 between the stop position and the loading position is stable and reliable. Optionally, the stop actuator 1372 may be a cylinder.

Further, the stop structure further comprises a drive rod 1377 (see FIG. 33). One end of the drive rod 1377 is connected to the second wedge block 1373, and the other end of the drive rod 1377 extends to an end of the carrier shaft 132 near the carrier seat 131 and is connected to a driving end of the stop actuator 1372. In this way, the drive rod 1377 is configured to transfer the linear motion output by the stop actuator 1372 along the axial direction of the carrier shaft 132 to the second wedge block 1373. Optionally, the carrier shaft 132 is provided with a receiving slot extending along its axial direction. The receiving slot is configured to receive the drive rod 1377 so as to avoid interaction between the drive rod 1377 and the standby material roll A2 on the carrier shaft 132.

Further, the second wedge block 1373 has a second inclined surface L2 parallel to the first inclined surface L1. The first inclined surface L1 and second inclined surface L2 fit together, so that the movement of the second wedge block 1373 relative to the first wedge block 1374 is smoother, and stable and reliable.

Further, the second wedge block 1373 further has an abutting plane for abutting the stop block 1371. The abutting plane is located on one side of the second wedge block 1373 facing away from the second inclined surface L2, and is parallel to the axial direction of the carrier shaft 132.

In a specific embodiment, the stop structure further includes a limit block 1375 and an elastic member 1376. The limit block 1375 is mounted within the mounting slot 1321, and is in sliding fit with the stop block 1371. When the stop block 1371 moves to the stop position, the limit block 1375 is limited against the stop block 1371 to prevent the stop block 1371 from continuing to move out of the mounting slot 1321. The elastic member 1376 is connected to the stop block 1371 and the limit block 1375 to provide a preload that causes the stop block 1371 to have a tendency to move toward the loading position.

In this way, see FIG. 33 and FIG. 35, when the stop actuator 1372 drives the second wedge block 1373 to the right, the second wedge block 1373 moves along an upward sloping direction of the first inclined surface L1 of the first wedge block 1374, thereby driving the stop block 1371 to move from the loading position to the stop position, such that the stop block 1371 protrudes from the circumferential side of the carrier shaft 132. When the stop actuator 1372 drives the second wedge block 1373 to the left, the second wedge block 1373 moves along a downward sloping direction of the first inclined surface L1 of the first wedge block 1374, causing the stop block 1371 to move into the mounting slot 1321 by the action of the elastic member 1376 until it completely enters the mounting slot 1321 (i.e., reaches the loading position). Optionally, the elastic member 1376 may be a torsion spring.

Referring further to FIG. 32 to FIG. 33, in some embodiments, each unwinding mechanism 11 further comprises an aligning assembly 12 comprising an aligning base plate 121 and an aligning actuator 122. The carrier seat 131 of the unwinding assembly 13 is movably connected to the aligning base plate 121 along the axial direction of the carrier shaft 132, and the carrier seat 131 can drive the carrier shaft 132 and the unwinding shaft to move axially together. The aligning actuator 122 is provided on the aligning base plate 121, and is in driving connection with the carrier seat 131 to drive the carrier seat 131 to move along the axial direction of the unwinding shaft, and then the carrier seat 131 drives the unwinding shaft and the working material roll A1 on the unwinding section 1332 of the unwinding shaft to move along the axial direction together, i.e., to achieve aligning of the working material strip B1. Optionally, the aligning actuator 122 may be a linear module or the like.

Further, a guiding structure comprising a slide rail and a slider may be provided between the aligning base plate 121 and the carrier seat 131, thereby guiding the movement of the carrier seat 131 relative to the aligning base plate 121 using the guiding structure of the slide rail and the slider.

In some embodiments, the material-prodding assembly 14 includes a material-prodding drive assembly 141 and a material-prodding fork 142 mounted at a driving end of the material-prodding drive assembly 141. The material-prodding fork 142 has a material-prodding end extending to the carrier shaft 132. The material-prodding drive assembly 141 is configured to drive the material-prodding fork 142 to move axially along the carrier shaft 132, thereby using the material-prodding end to prod the standby material roll A2 on the carrier shaft 132 toward the unwinding section 1332 until the foremost standby material roll A2 moves onto the unwinding section 1332. Further, a shape of the material-prodding end matches a shape of the circumferential surface of the carrier shaft 132 to facilitate better prodding of the standby material roll A2. Optionally, the material-prodding drive assembly 141 may employ a linear module, and so on.

Figure 36:
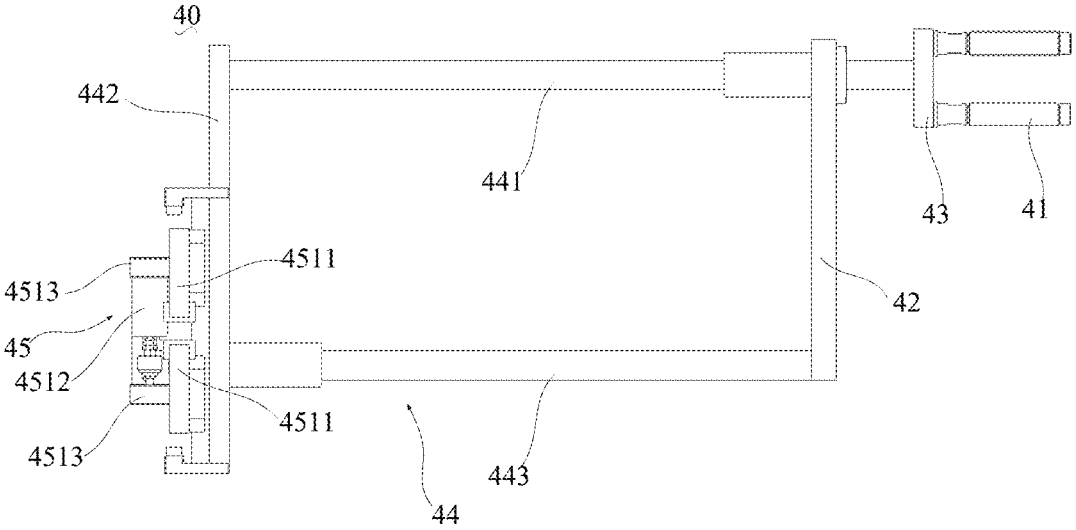
FIG. 36 shows a schematic diagram of the structure of the guide device in an embodiment of the present application.

Referring to FIG. 32 and FIG. 36, in an embodiment of the present application, the automatic roll-replacing apparatus further includes a guide device 40 for guiding the working material strip B1 output by either of the two unwinding mechanisms 11. The unwinding assembly 13 of each unwinding mechanism 11 further includes a connecting drive block 15 connected to the carrier seat 131 or the carrier shaft 132. For the convenience of description, the two unwinding mechanisms 11 of the unwinding assemblies 13 are named a first unwinding assembly 13*a* and a second unwinding assembly 13*b*, respectively.

The guide device 40 comprises a fixed seat 42, a guide frame 44 and a switching mechanism 45. The guide frame 44 is movably connected to the fixed seat 42 in a direction parallel to the axial direction of the unwinding shaft of the unwinding assembly 13. A guide roller 41 is amounted on the guide frame 44 for winding of the working material strip B1. The switching mechanism 45 is connected to the guide frame 44, and is selectively connected to the connecting drive block 15 of the first unwinding assembly 13*a* or connected to the connecting drive block 15 of the second unwinding assembly 13*b*.

When the material roll on the first unwinding assembly 13*a* is the working material roll A1, the material roll on the second unwinding assembly 13*b* is the standby material roll A2, and the first unwinding assembly 13 performs the aligning, firstly, the above-mentioned guide device 40 controls the switching mechanism 45 to connect to the connecting drive block 15 of the first unwinding assembly 13*a*, so that the first unwinding assembly 13*a* is driven by the aligning assembly 12 to perform aligning movement along axial direction of the unwinding shaft while the guide frame 44 and the guide roller 41 on the guide frame 44 are driven to simultaneously perform aligning movement.

When the material roll on the second unwinding assembly 13*b* is the working material roll A1 and the material roll on the first unwinding assembly 13*a* is the standby material roll A2, and the second unwinding assembly 13*b* performs the aligning, first the switching mechanism 45 is controlled to be connected to the connecting drive block 15 of the second unwinding assembly 13*b*, so that the second unwinding assembly 13*b* is driven by the aligning assembly 12 to perform deflecting movement along the axial direction of the unwinding shaft while the guide frame 44 and the guide roller 41 on the guide frame 44 are driven to simultaneously perform aligning movement. In this way, the switching mechanism 45 is selectively connected to one of the connecting driving blocks 15 of the two unwinding assemblies 13 in the embodiment, thereby ensuring excellent alignment of the guiding roller 41 and the unwinding shaft loaded with the working material roll A1, enhancing the aligning effect and ensuring product quality.

In some embodiments, the switching mechanism 45 includes a first holding assembly 451 and a second holding assembly 452 which are mounted on the guide frame 44. The first holding assembly 451 may be connected or separated from the connecting drive block 15 of one of the unwinding assemblies 13, and the second holding assembly 452 may be connected or separated from the connecting drive block 15 of the other of the unwinding assemblies 13. For example, the first holding assembly 451 may be connected or separated from the connecting drive block 15 of the first unwinding assembly 13*a*. The second holding assembly 452 may be connected or separated from the connecting drive block 15 of the second unwinding assembly 13*b*. In this way, when the material roll on the first unwinding assembly 13*a* is a working material roll A1, the first holding assembly 451 is connected to the connecting drive block 15 of the first unwinding assembly 13*a*, and the second holding assembly 452 is separated from the connecting drive block 15 of the second unwinding assembly 13*b*, causing the guide roller 41 and the first unwinding assembly 13*a* to perform a simultaneous aligning movement. When the material roll on the second unwinding assembly 13*b* is a working material roll A1, the first holding assembly 451 is separated from the connecting drive block 15 of the first unwinding assembly 13*a*, and the second holding assembly 452 is connected to the connecting drive block 15 of the second unwinding assembly 13*b*, causing the guide roller 41 and the second unwinding assembly 13*b* to perform a simultaneous aligning movement.

In a specific embodiment, the first holding assembly 451 includes two first holding blocks 4511 and a first holding actuator 4512. The two first holding blocks 4511 are provided opposite to each other on the guide frame 44. The first holding actuator 4512 is in transmission connected to the two first holding blocks 4511. Under drive of the first holding actuator 4512, at least one of the two first holding blocks 4511 moves close to or away from the other to clamp or release the connecting drive block 15 corresponding to the unwinding assembly 13.

Further, the two first holding blocks 4511 are each connected to a first connecting block 4513. The first holding actuator 4512 has a first fixed end and a first retractable end that is retractable relative to the first fixed end. The first fixed end and the first retractable end are respectively connected with two first connecting blocks 4513, so as to drive the two first holding blocks 4511 to clamp or release the connecting drive block 15 corresponding to the unwinding assembly 13 through the extension and retraction of the first retractable end relative to the first fixed end. Optionally, the first holding actuator 4512 may be a cylinder.

Further, the guide frame 44 is provided with a first slide rail, and both of the two first holding blocks 4511 are provided with first sliders which slidingly fit the first slide rail. In this way, the two first sliders are configured to slide along the first slide rail respectively to guide the two first holding blocks 4511 to move relative to the guide frame 44 close to or away from each other.

In a specific embodiment, the second holding assembly 452 includes two second holding blocks 4521 and a second holding actuator 4522. The two second holding blocks 4521 are provided opposite to each other on the guide frame 44. The second holding actuator 4522 is in transmission connected to the two second holding blocks 4521. Under the drive of the second holding actuator 4522, at least one of the two second holding blocks 4521 moves close to or away from the other to clamp or release the connecting drive block 15 corresponding to the unwinding assembly 13.

Further, the two second holding blocks 4521 are each connected to a second connecting block 4523. The second holding actuator 4522 has a second fixed end and a second retractable end that is retractable relative to the second fixed end. The second fixed end and the second retractable end are respectively connected with two second connecting blocks 4523, so as to drive the two second holding blocks 4521 to clamp or release the connecting drive block 15 corresponding to the unwinding assembly 13 through the extension and retraction of the second retractable end relative to the second fixed end. Optionally, the second holding actuator 4522 may be a cylinder.

Further, the guide frame 44 is provided with a second slide rail, and both of the second holding blocks 4521 are provided with second sliders which slidingly fit the second slide rail. In this way, the two second sliders are configured to slide along the second slide rail respectively to guide the two second holding blocks 4521 to move relative to the guide frame 44 close to or away from each other.

In some embodiments, the guide frame 44 includes a first guide pillar 441, a guide roller seat 43, and a motion seat 442. The first guide pillar 441 slidingly fits the fixed seat 42. The guide roller seat 43 is connected to one end of the first guide pillar 441, so that the guide roller seat 43 can move with the first guide pillar 441 relative to the fixed seat 42. The guide roller 41 is mounted on the guide roller seat 43, so that it can move with the guide roller seat 43 together. The motion seat 442 is connected to the other end of the first guide pillar 441, and the above-mentioned switching mechanism 45 is mounted on the motion seat 442. In this way, when the switching mechanism 45 is connected to the connecting drive block 15 of one of the unwinding assemblies 13 and the unwinding assembly 13 performs an aligning movement, the motion seat 442 is driven to move synchronously by the switching mechanism 45, and in turn the motion seat 442 drives the guide roller 41 to move synchronously by the first guide pillar 441 and the guide roller seat 43, to ensure that the guide roller 41 and the unwinding shaft of the unwinding assembly 13 are synchronously deviation-rectified.

In a specific embodiment, the guide frame 44 further includes a second guide pillar 443 slidingly fitting the motion seat 442, and one end of the second guide pillar 443 is connected to the fixed seat 42. In this way, the movement of the movement seat 442 and the guide roller seat 43 is guided by using the first guide pillar 441 and the second guide pillar 443 together.

In a specific embodiment, the guide device 40 further comprises a locking assembly 46 provided on the motion seat 442. The locking assembly 46 is constructed to be able to be connected to or separated from the second guide pillar 443. In this way, when automatic roll-replacement is required, the locking assembly 46 is connected to the second guide pillar 443 such that the motion seat 442 cannot move relative to the fixed seat 42, thereby locking the position of the guide roller 41 and ensuring that the working material strip B1 wound on the guide roller 41 does not move, thereby ensuring that the standby material strip B2 of the standby material roll A2 is aligned with the working material strip B1 when automatic roll-replacement is performed. When aligning is required, the locking assembly 46 is separated from the second guide pillar 443, and the motion seat 442 can follow the unwinding assembly 13 in a synchronized aligning movement.

Optionally, the locking assembly 46 includes a locking-actuator and a clamping jaw. The locking-actuator is mounted on the motion seat 442, and the clamping jaw is mounted on a driving end of the locking-actuator. The locking-actuator is configured to drive the clamping jaw to clamp or release the second guide pillar 443. In this way, when the locking-actuator drives the clamping jaw to clamp the second guide pillar 443, the motion seat 442 cannot move relative to the fixed seat 42, i.e., locking the position of the guide roller 41. When the locking-actuator drives the clamping jaws to release the second guide pillar 443, the motion seat 442 can move relative to the fixed seat 42, enabling the guide roller 41 to perform via the switching mechanism 45, a synchronized aligning movement with any one of the unwinding assemblies 13. Optionally, the locking-actuator may be a jaw cylinder.

The automatic roll-replacing process of the automatic roll-replacing apparatus of the application is described below referring to FIG. 3 to FIG. 7.

Initially, the material roll on the first unwinding mechanism 11*a* is a working material roll A1, and the unwinding output of a working material strip B1 is conveyed downstream through the guide roller 41. The material roll on the second unwinding mechanism 11*b* is a backup material roll A2. The first abutting portion 310 and the second abutting portion 311 of the first strip-connecting mechanism 31*a* have tape C adsorbed on them together, and the first abutting portion 310 and the second abutting portion 311 of the second strip-connecting mechanism 31*b* do not have tape C adsorbed on them.

When the unwinding of the working material roll A1 on the first unwinding mechanism 11*a* is completed, an automatic roll-replacement is required. First, the pick-up mechanism 22 is driven by the first swing mechanism 23 to swing in a clockwise direction until both the first gripping member 2221 and the second gripping member 2223 are against the standby material roll A2 on the second unwinding mechanism 11*b*, and the material strip starting end B21 of the standby material roll A2 is located between the first gripping member 2221 and the second gripping member 2223.

Then, the two blowing surfaces g2 on the second gripping member 2223 blow air, thereby blowing the two edge portions B211 of the material strip starting end B21 up onto each of the two second adsorption surfaces g1 on the first gripping member 2221 and are adsorbed by the two second adsorption surfaces g1. The second gripping member 2223 is controlled to move towards the first gripping member 2221 until it clamps the two edge portions B211 of the material strip starting end B21 together with the first gripping member 2221.

And then, the pick-up mechanism 22 is driven by the first swing mechanism 23 to swing in a counterclockwise direction until the first gripping member 2221 and the second gripping member 2223 drive the material strip starting end B21 to pass between the avoidance position and the strip-connecting position (i.e., pass through the upper part of the support mechanism 21). The support mechanism 21 moves upward to the strip-connecting position, so that the standby material strip B2 is wound onto and passed through the second support roller 213 of the support mechanism 21.

And then, the first strip-connecting mechanism 31*a* follows the second swing arm 322 to swing clockwise to the strip-connecting position, so that the abutting roller 313 of the first strip-connecting mechanism 31*a* presses the standby material strip B2 against the first support roller 212. The second gripping member 2223 is controlled to move away from the first gripping member 2221, thereby releasing the material strip starting end B21. The second unwinding mechanism 11*b* drives the standby material roll A2 to rotate clockwise, so that the standby material strip B2 gradually winds on the standby material roll A2 until the material strip starting end B21 is adsorbed on the first adsorption surface 2101 on the left side of the support block 210. In the process of winding the standby material strip B2, the two first adsorption surfaces 2101 on the left and right sides of the support block 210 adsorb the standby material strip B2 passing by, respectively, avoiding the material strip starting end B21 from swinging freely.

And then, the first abutting portion 310 and the second abutting portion 311 of the first strip-connecting mechanism 31*a* move to the left until the first abutting portion 310 presses the tape C and the standby material strip B2 against the first adsorption surface 2101 on the right side of the support block 210, so that the right side of the standby material strip B2 is bonded to a lower part of the tape C.

And then, the second strip-connecting mechanism 31*b* follows the second swing arm 322 to swing counterclockwise to the strip-connecting position, so that the abutting roller 313 of the second strip-connecting mechanism 31*b* presses the working material strip B1 against the first support roller 212. The first abutting portion 310 and the second abutting portion 311 of the second strip-connecting mechanism 31*b* are controlled to move to the right until the first abutting portion 310 presses the working material strip B1 and the material strip starting end B21 against the first adsorption surface 2101 on the left side of the support block 210. The cutting member 312 of the second strip-connecting mechanism 31*b* is controlled to cut off the working material strip B1 between the abutting roller 313 and the first abutting portion 310. Then, the second abutting portion 311 of the second strip-connecting mechanism 31*b* is controlled to move to the right until the second abutting portion 311 presses the working material strip B1 against the tape C of the second abutting portion 311 of the first strip-connecting mechanism 31*a*, so that the working material strip B1 is bonded to an upper part of the tape C. At this time, both the right sides of the working material strip B1 and the standby material strip B2 are bonded to the tape C, and the strip-connecting is completed.

And then, the first strip-connecting mechanism 31*a* follows the second swing arm 322 to swing counterclockwise to the tape preparation position, the second strip-connecting mechanism 31*b* follows the second swing arm 322 to swing clockwise to the tape preparation position, and the support mechanism 21 moves downward to the avoidance position. The standby material roll A2 on the second unwinding mechanism 11*b* switches to the working material roll A1, and the second unwinding mechanism 11*b* drives the working material roll A1 on it to rotate counterclockwise, thereby conveying the working material strip B1 downstream.

After the working material strip B1 is cut off, the empty cylinder A3 on the first unwinding mechanism 11*a* can be carried to the material-winding shaft 341 of the cylinder collecting mechanism 34 by using the cylinder conveying mechanism 35. When the second strip-connecting mechanism 31*b* swings to the tape preparation position, the tape preparation mechanism 33 can be configured to prepare tape on the first abutting portion 310 and the second abutting portion 311 of the second strip-connecting mechanism 31*b* in preparation for the next automatic roll-replacement.

The conveyance of the empty cylinder A3 and the process of preparing tape for the strip-connecting mechanism 31 are described in the previous section and will not be repeated here.

It should be noted that the starting-end-handling device is not limited to picking up the material strip starting end B21 on the standby material roll A2 by means of clamping as in the first embodiment above. In the second embodiment, picking up the material strip starting end B21 on the standby material roll A2 can also be achieved by means of sticking using the tape material strip E.

The second embodiment is described below. For the convenience of description, only the differences between the second embodiment and the first embodiment are described. Referring to FIG. 11 to FIG. 14, in the second embodiment, the pick-up mechanism 22 includes a mounting seat 221 and a sticking assembly (not shown). The mounting seat 221 can be controlled to move close to or away from the standby material roll A2. The sticking assembly includes a tape-unwinding structure 224, a tape-winding structure 225 and a sticking member 226 all provided on the mounting seat 221. The tape-unwinding structure 224 is configured to output a tape material strip E to the sticking member 226, so that the tape material strip E is wound onto and passed through the sticking member 226. One side of the tape material strip E facing away from the sticking member 226 is the adhesive side, i.e., the non-adhesive side of the tape material strip E is in contact with the sticking member 226. The tape-winding structure 225 is configured to wind the tape material strip E after it has been wound onto and passed through the sticking member 226. Wherein, when the mounting seat 221 moves close to the standby material roll A2, can drive the sticking member 226 against the standby material roll A2, so that the tape material strip E on the sticking member 226 sticks the material strip starting end B21 on the standby material roll A2.

In this way, when it is necessary to pick up the material strip starting end B21 on the standby material roll A2 (see FIG. 11 to FIG. 14), first, the mounting seat 221 is controlled to move close to the standby material roll A2 until it drives the sticking member 226 against the standby material roll A2, so that the tape material strip E wound onto and passed through the sticking member 226 sticks to the material strip starting end B21 on the standby material roll A2. Then, the mounting seat 221 moves away from the standby material roll A2. Since the material strip starting end B21 on the standby material roll A2 is bonded and fixed to the tape material strip E, the standby material strip B2 on the standby material roll A2 is thereby pulled out for subsequent strip-connecting of the standby material strip B2 and the working material strip B1.

In this way, the tape material strip E wound onto and passed through the sticking member 226 is configured to stick the material strip starting end B21 of the standby material roll A2, and the standby material strip B2 of the standby material roll A2 is pulled out by moving the mounting seat 221 away from the standby material roll A2. The tape material strip E is configured to stick the material strip starting end B21 so as to fix it, which improves robustness and stability of the fixing of the material strip starting end B21, so that the material strip starting end B21 will not fall off and lead to the failure to pull out the standby material strip B2, thus improving the stability of the operation of the apparatus.

In a specific embodiment, the sticking member 226 may be a sticking roller which is connected to the mounting seat 221 in a way that the sticking roller is rotatable about its own axis, thereby enabling the tape material strip E to be wound smoothly around the sticking roller.

Further, when the sticking roller is driven by the mounting seat 221 so as to be pressed against the standby material roll A2, the sticking roller is driven to rotate by the tape-winding structure 225 which winds the tape material strip E, wherein the rotating direction of the sticking roller is opposite to the rotating direction of the standby material roll A2. Accordingly, the tape material strip E sticks a section of the standby material strip B2 released from the standby material roll A2, i.e. the tape material strip E sticks a longer section of the standby material strip B2, so as to fix the standby material strip B2 securely, further preventing the start of the material strip starting end B21 from falling off. In this way, when it is necessary to pick up the material strip starting end B21 on the standby material roll A2 (see FIG. 11 to FIG. 14), first, the mounting seat 221 is controlled to move close to the standby material roll A2 until the sticking roller is driven against the standby material roll A2, so that the tape material strip E wound on the sticking roller sticks the material strip starting end B21 on the standby material roll A2. Then, the tape-winding structure 225 and the tape-unwinding structure 224 drive the tape material strip E to move a distance, and at the same time the standby material roll A2 rotates and unwinds a section of the standby material strip B2. The section of the standby material strip B2 unwound is bonded and fixed to the tape material strip E because the sticking roller remains pressed against the standby material roll A2. That is to say, at this time, in addition to the material strip starting end B21 of the standby material strip B2 being bonded and fixed to the tape material strip E, a section of the standby material strip B2 is also bonded and fixed to the tape material strip E, improving robustness of the adhesion of the standby material strip B2. Then, the mounting seat 221 is controlled to move away from the standby material roll A2. Since the material strip starting end B21 on the standby material roll A2 is bonded and fixed to the tape material strip E, the standby material strip B2 on the standby material roll A2 is pulled out, so that subsequently the standby material strip B2 and the working material strip B1 are roll-replaced.

Figure 12:
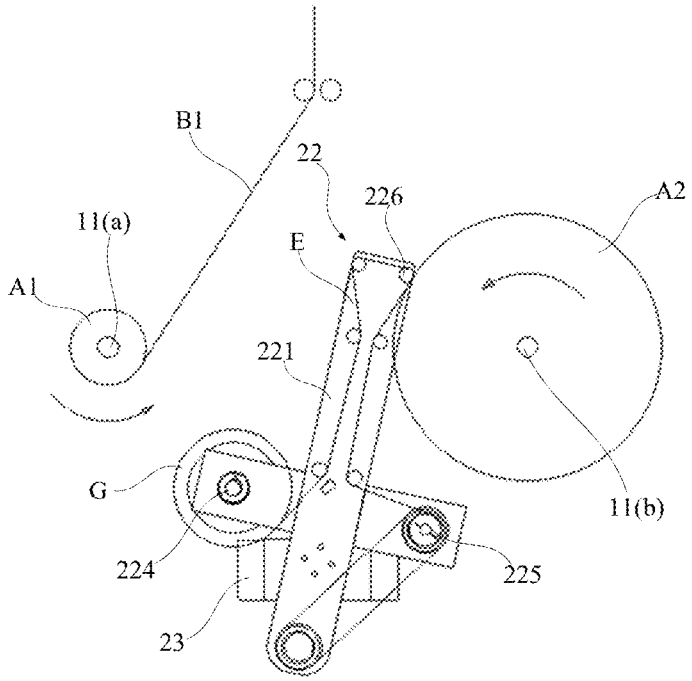
Figure 13:
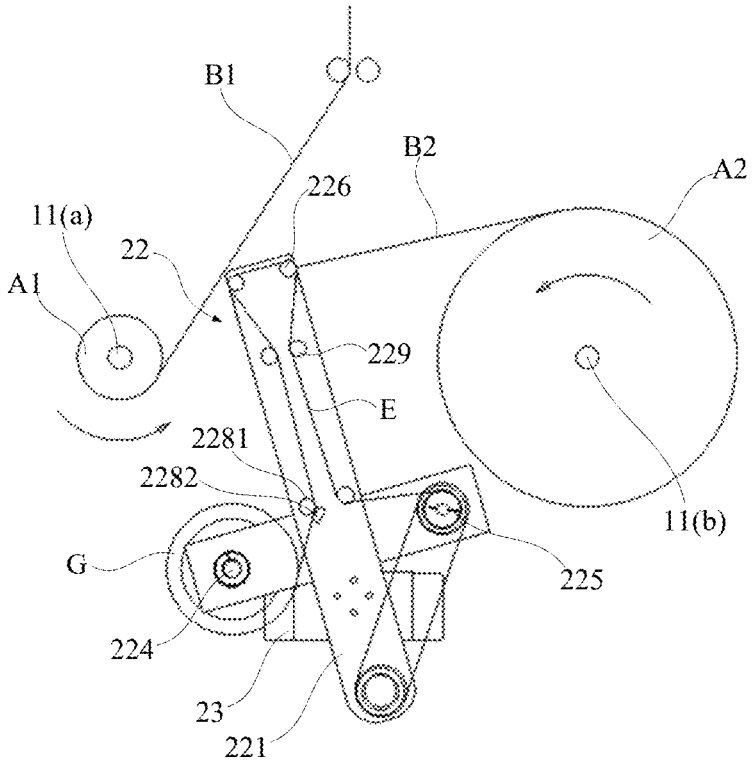
Figure 14:
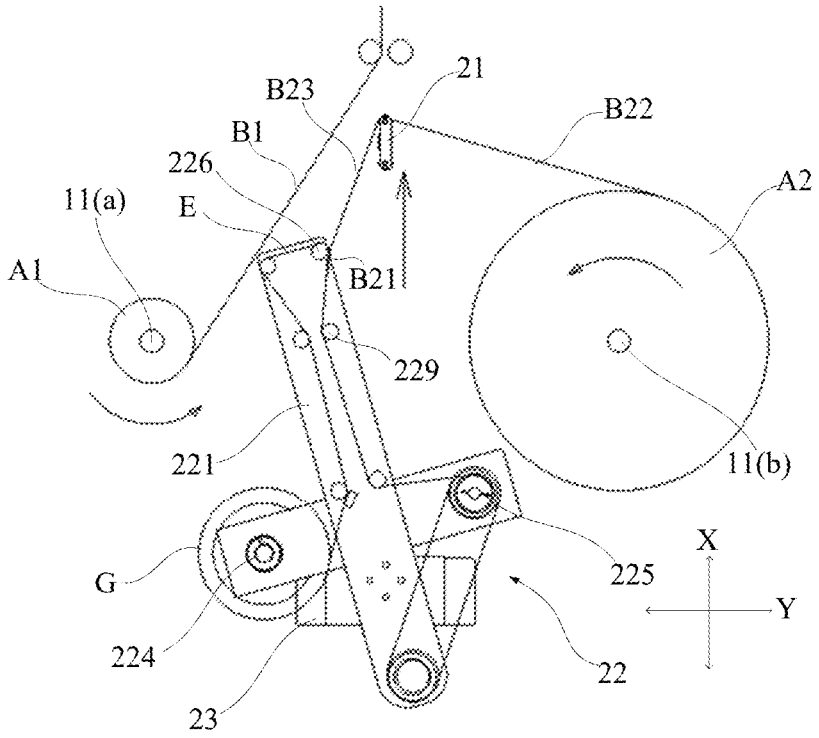
Figure 15:
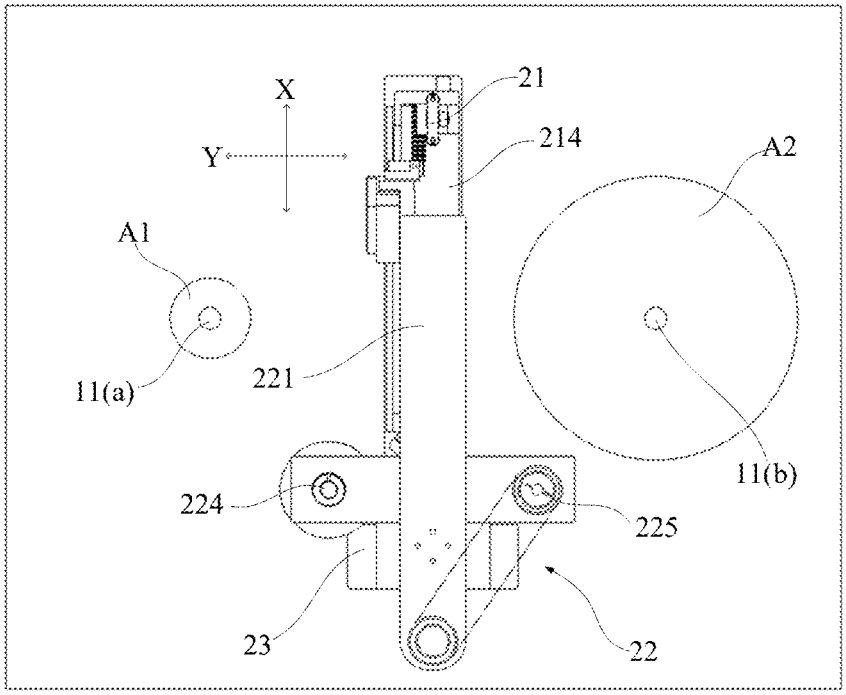
FIG. 15 shows a main view of the starting-end-handling device shown in FIG. 11.

It should be noted that, in order to ensure that the standby material strip B2 unwound by the rotation of the standby material roll A2 can be bonded to the tape material strip E, the rotation direction of the sticking roller driven by the tape material strip E when the tape material strip E travels is opposite to the rotation direction of the standby material roll A2 (i.e., as shown in FIG. 12, the sticking roller rotates clockwise and the standby material roll A2 rotates counter-clockwise), so that the tape material strip E and the standby material strip B2 between the sticking roller and the standby material roll A2 travel in the same direction, thus ensuring that the standby material strip B2 can be adhered to the tape material strip E.

Figure 17:
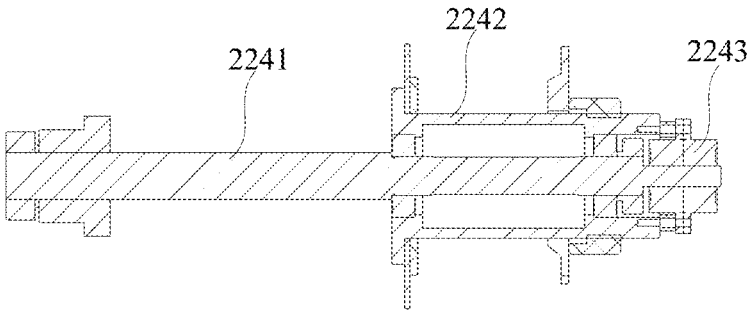
FIG. 17 is a sectional view of the tape-unwinding structure of the starting-end-handling device shown in FIG. 15.

Referring to FIG. 17, in a specific embodiment, the tape-unwinding structure 224 includes a fixed shaft 2241, an unwinding roller 2242, and a damper 2243. The fixed shaft 2241 is fixedly mounted on the mounting seat 221. The unwinding roller 2242 is sleeved on the fixed shaft 2241 with a bearing, so that the unwinding roller 2242 can rotate about its own axis relative to the fixed shaft 2241. The unwinding roller 2242 is configured to load the tape material roll G (see FIG. 11), so that the unwinding roller 2242 rotates in synchronization with the tape material roll G. The damper 2243 is mounted between the unwinding roller 2242 and the fixed shaft 2241. In this way, during unwinding, the tape-winding structure 225 wind the tape material strip E (see FIG. 11), and the tape-winding structure 225 pulls and drives the unwinding roller 2242 and the tape material roll G thereon to rotate relative to the fixed shaft 2241, thereby unwinding the tape material strip E. When unwinding is stopped, the tape-winding structure 225 stops winding the tape material strip E, and the unwinding roller 2242 also stops rotating relative to the fixed shaft 2241 under the damping provided by the damper 2243, i.e., stops unwinding the tape material strip E.

Figure 18:
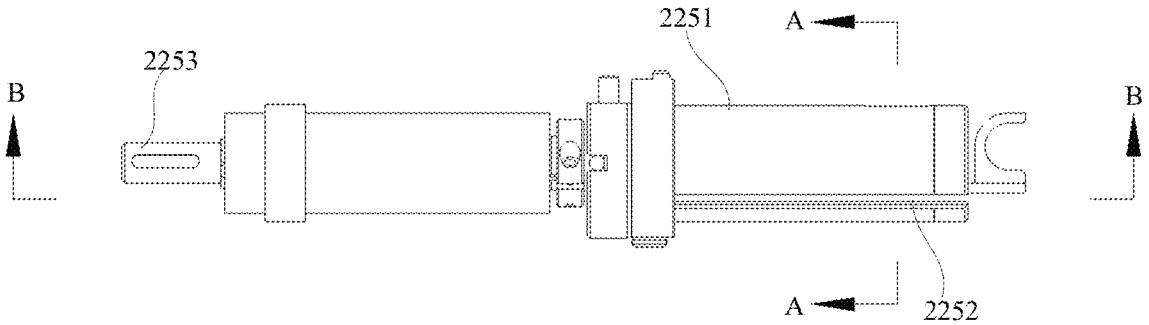
FIG. 18 shows a main view of the tape-winding structure of the starting-end-handling device shown in FIG. 15.
Figure 19:
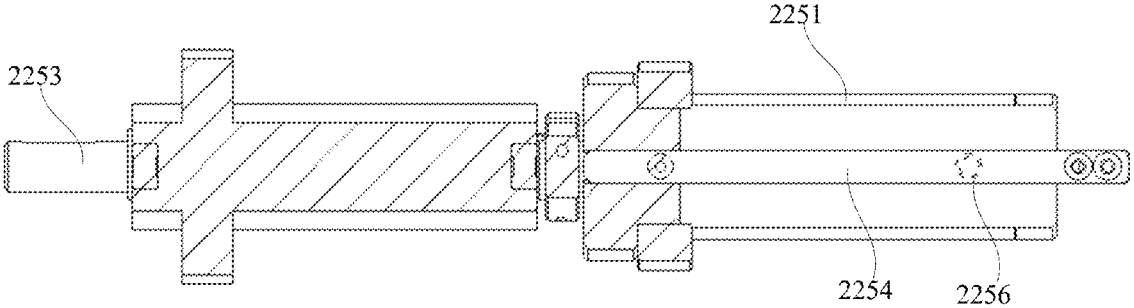
FIG. 19 is a sectional view along the B-B direction of the tape-winding structure shown in FIG. 18.
Figure 20:
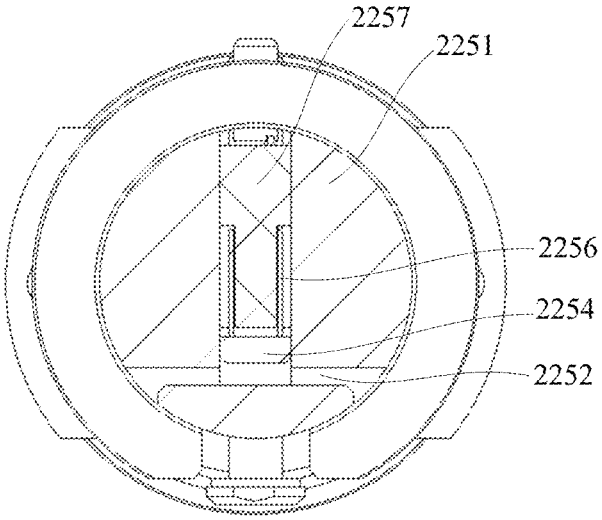
FIG. 20 is a sectional view along the A-A direction of the tape-winding structure shown in FIG. 18.
Figure 21:
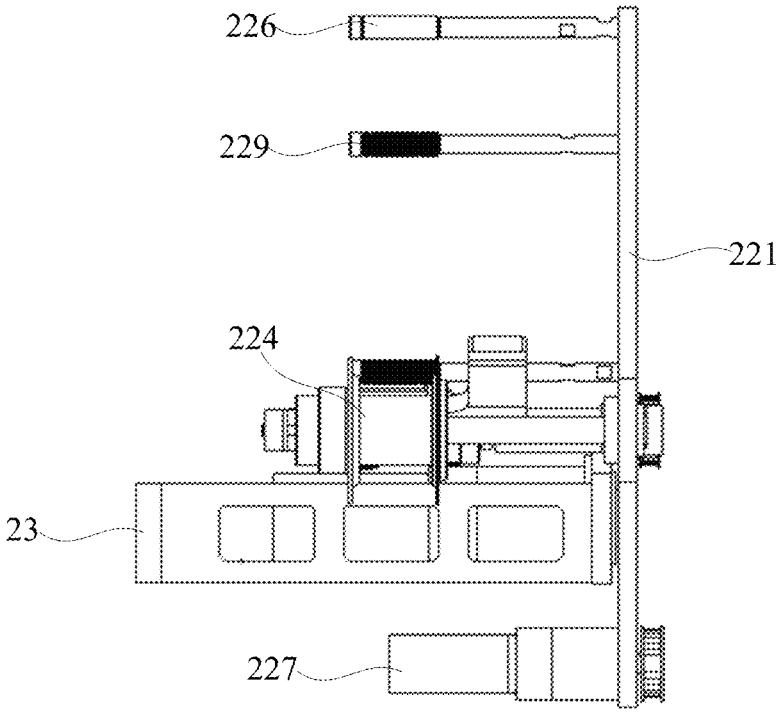
FIG. 21 shows a main view of the pick-up mechanism of the starting-end-handling device shown in FIG. 15.
Figure 22:
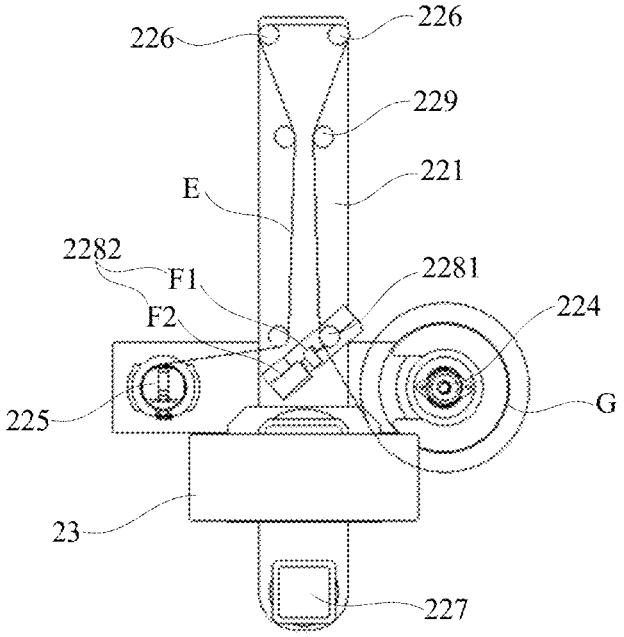
FIG. 22 shows a left view of the pick-up mechanism shown in FIG. 21.
Figure 23:
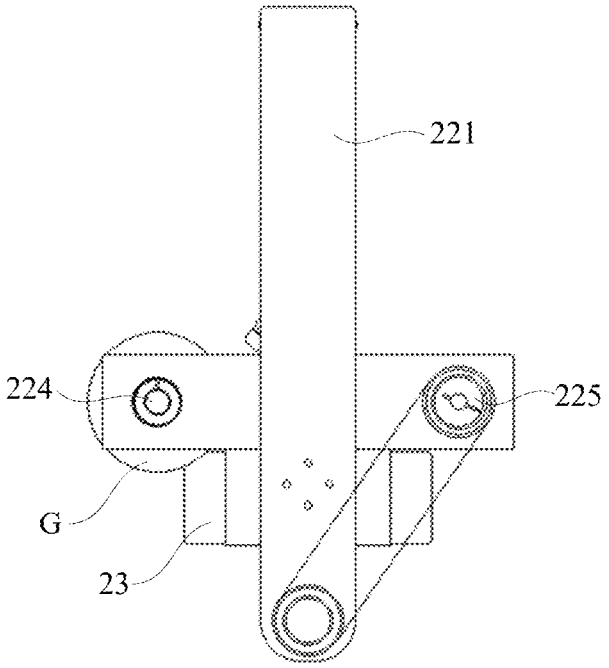
FIG. 23 shows a right view of the pick-up mechanism shown in FIG. 21.
Figure 24:
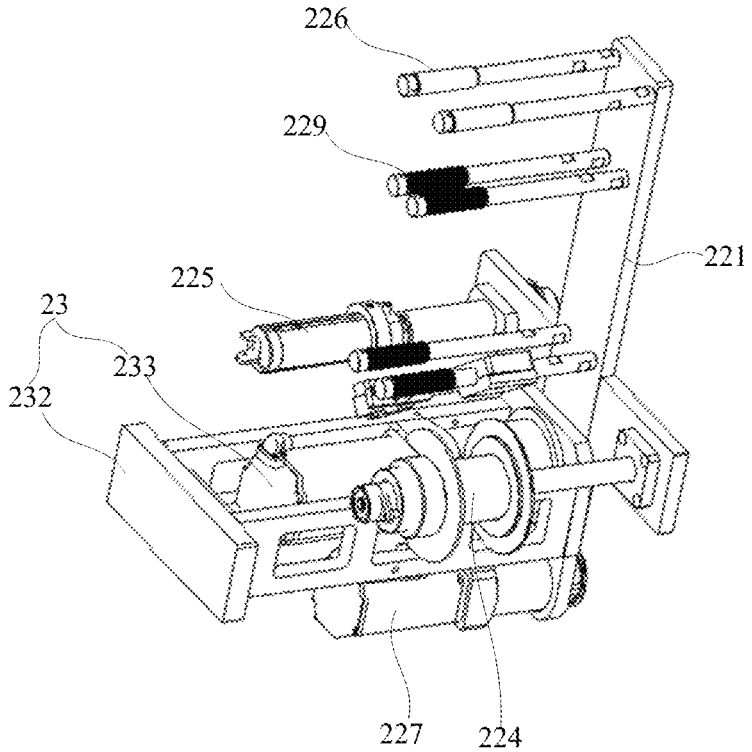
FIG. 24 shows a three-dimensional view of the pick-up mechanism shown in FIG. 21.

Referring to FIG. 18 to FIG. 20, in a specific embodiment, the tape material-winding structure 225 comprises a winding roller 2251, which is connected to the mounting seat 221 in a way that the winding roller 2251 is rotatable about its own axis. The winding roller 2251 has a strip-passing slit 2252 extending along its own axis, the strip-passing slit 2252 is for a starting end of the tape material strip E to insert. At the inside of the winding roller 2251 there is provided a pressing member 2254, which is configured for pressing and fixing the starting end of the tape material strip E inserted into the strip-passing slit 2252. In this way, when installing the tape material roll G, the tape material roll G is first mounted on the unwinding roller 2242, then the starting end of the tape material strip E on the tape material roll G is pulled so as to be wound onto and passed through the sticking roller to reach the winding roller 2251. Next, the starting end of the tape material strip E is inserted into the strip-passing slit 2252 of the winding roller 2251, and then the starting end of the tape material strip E is pressed and fixed into the strip-passing slit 2252 using the pressing member 2254 in the winding roller 2251. In this way, the winding roller 2251 can wind the tape material strip E when the winding roller 2251 is rotating.

Further, the tape-winding structure 225 further comprises an abutting seat 2257 and an elastic member 2256. The abutting seat 2257 is fixedly mounted in the winding roll 2251. The pressing member 2254 is mounted on the winding roller 2251 by a limiting screw; enabling the pressing member 2254 to move relative to the abutting seat 2257. The elastic member 2256 is abutted between the abutting seat 2257 and the pressing member 2254, and the elasticity of the elastic member 2256 drives the pressing member 2254 to move and enter the strip-passing slit 2252 until the starting end of the tape material strip E inserted into the strip-passing slit 2252 is pressed and fixed. Optionally, the elastic member 2256 may be a spring.

Figure 16:
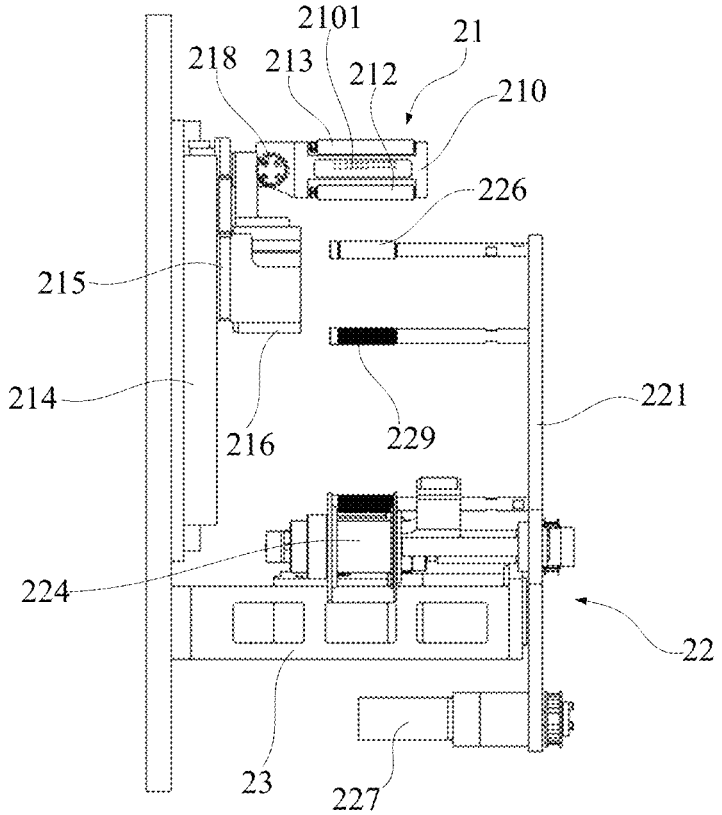
FIG. 16 shows a side view of the starting-end-handling device shown in FIG. 15.

Further, the tape-winding structure 225 further comprises a drive shaft 2253 and a winding actuator 227 (see FIG. 16 and FIG. 17). The drive shaft 2253 is rotatably connected to the mounting seat 221 and coaxially connected to the winding roll 2251, so that the drive shaft 2253 can drive the winding roll 2251 to rotate synchronously. The winding actuator 227 is mounted on the mounting seat 221 and is in driving connection with the drive shaft 2253 to drive the drive shaft 2253 to rotate, therefore the drive shaft 2253 drives the winding roller 2251 to rotate, and the winding shaft 2251 rotates to achieve winding of the tape material strip E.

Optionally, an output shaft of the winding actuator 227 is in driving connection with the drive shaft 2253 by a belt drive structure, so that the winding actuator 227 can drive the drive shaft 2253 to rotate through the belt drive structure. Optionally, the winding actuator 227 may employ an electric motor.

Referring to FIGS. 21 to 24, it should be noted that the tape material strip E must not waggle or move during the pulling out of the standby material strip B2, otherwise the standby material strip B2 will not be pulled out in place or the standby material strip B2 will not be pulled out. In a specific embodiment, to avoid waggling or movement of the tape material strip E during the pulling out of the standby material strip B2, the pick-up mechanism 22 further comprises a first over-roller 2281 and a pressing assembly 2282. The first over-roller 2281 is connected to the mounting seat 221 in a way that the first over-roller 2281 is rotatable about its own axis and is positioned between the tape-unwinding structure 224 and the sticking member 226. The first over-roller 2281 is used for winding through the tape material strip E passing between the tape-unwinding structure 224 and the sticking member 226. The pressing assembly 2282 controllably presses the tape material strip E winding through the first over-roller 2281 against the first over-roller 2281, thereby preventing the tape material strip E from continuing to travel and avoiding waggling or movement of the tape material strip E during pulled out of the standby material strip B2. It should be noted that, in order to avoid adhesion of the first over-roller 2281 to the tape surface of the tape material strip E, the circumferential surface of the first over-roller 2281 needs to be treated with an anti-adhesive treatment.

Further, the pressing assembly 2282 includes a pressing actuator F2 and a pressing block F1. The pressing actuator F2 is mounted on the mounting seat 221. The pressing block F1 is mounted on a driving end of the pressing actuator F2, so that the pressing actuator F2 can drive the pressing block F1 close to or away from the first over-roller 2281, thereby enabling the pressing block F1 to press or loosen the tape material tape E wound on the first over-roller 2281.

It should be noted that at least one guide passing-roller 229 is provided between the tape-winding structure 225 and the sticking member 226 for the tape material strip E to be wound onto and passed through. The guide passing-roller 229 is configured to guide the tape material strip E, so that the tape material strip E passing by the sticking member 226 travels to the tape-winding structure 225. In the same way, at least one guide passing-roller 229 is provided between the sticking member 226 and the tape-unwinding structure 224 for the tape material strip E to be wound onto and passed through. The guide passing-roller 229 is configured to guide the tape material strip E, so that the tape material strip E unwound from the tape-unwinding structure 224 travels to the sticking member 226.

In a specific embodiment, two sticking members 226 are provided. When the material roll on the first unwinding mechanism 11*a* is the standby material roll A2, the mounting seat 221 can drive one of the sticking members 226 against the material roll on the first unwinding mechanism 11*a*. When the material roll on the second unwinding mechanism 11*b* is the standby material roll A2, the mounting seat 221 can drive the other sticking member 226 against the material roll on the second unwinding mechanism 11*b*.

Figure 11:
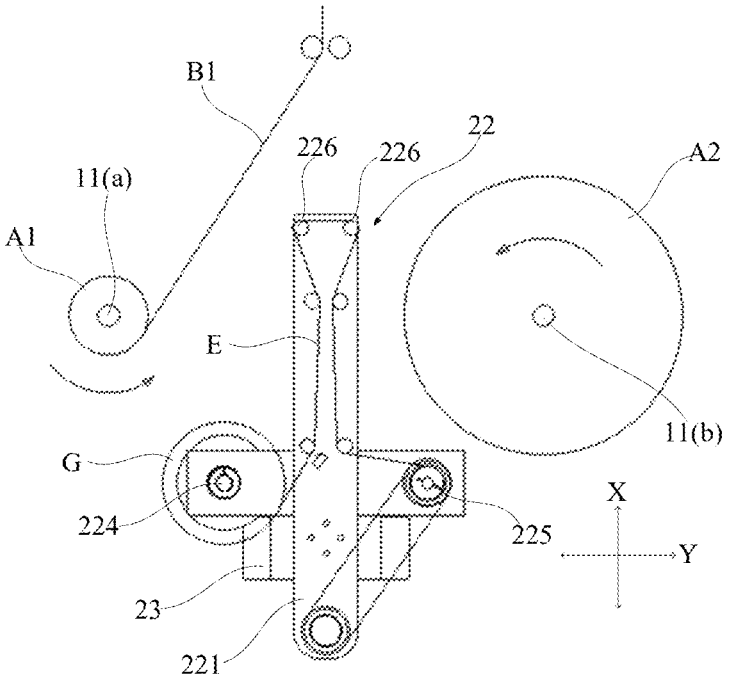
FIGS. 11 to 14 are structural schematic diagrams of the action process of the pick-up mechanism of the starting-end-handling device pulling out the standby material strip in another embodiment of the present application.

In a specific embodiment shown in FIG. 11, the left material roll is the working material roll A1, and the right material roll is the standby material roll A2. When the standby material roll B2 needs to be pulled out, the mounting seat 221 drives the right sticking member 226 against the right material roll, causing the tape material strip E to stick the material strip starting end B21 on the right material roll. Then, the mounting seat 221 drives the right sticking member 226 toward the left material roll, so as to pull out the standby material strip B2 on the right material roll.

Figure 26:
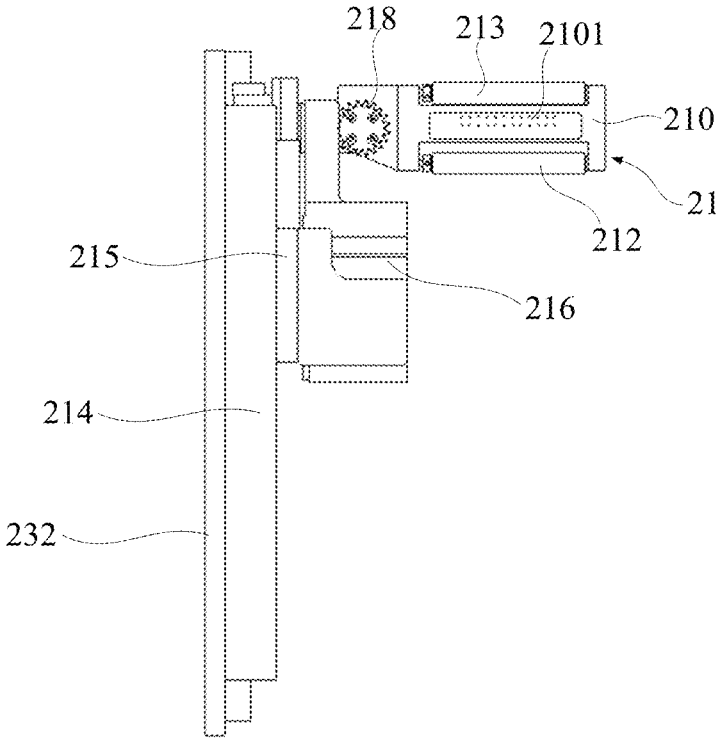
FIG. 26 shows a side view of the support mechanism shown in FIG. 25.

In a specific embodiment, the support mechanism has an avoidance state and a strip-connecting state. When the support mechanism 21 is in the avoidance state, the support mechanism 21 provides collision avoidance for the movement of the sticking member 226 driven away from the standby material roll A2 by the mounting seat 221 (i.e., to prevent the support mechanism 21 from colliding with the guide passing-roller 229 on the mounting seat 221), thereby ensuring that the standby material strip B2 on the standby material roll A2 can be pulled out smoothly. When the support mechanism 21 is in the strip-connecting state (as shown in FIG. 26), the support mechanism 21 is used for winding through the standby material strip B2 pulled out by the tape material strip E on the sticking member 226, thus enabling the support mechanism 21 to cooperate with the strip-connecting device in the strip-connecting action of the standby material strip B2 and the working material strip B1 on the support mechanism 21.

Further, the support mechanism 21 further includes a transferring seat 215. The transferring seat 215 is mounted on the driving end of the lift assembly 214, such that the lift assembly 214 can drive the transferring seat 215 to move between the avoidance position and the strip-connecting position in the first direction X. One end of the support block 210 is rotatably connected to the transferring seat 215.

Figure 25:
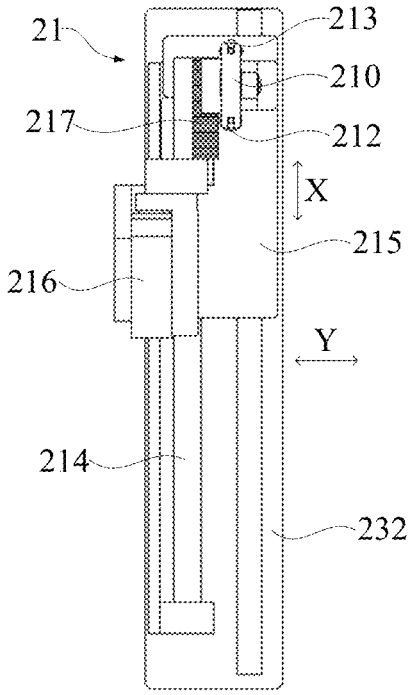
FIG. 25 shows a main view of the support mechanism of the starting-end-handling device shown in FIG. 15.

When the support mechanism 21 is in the strip-connecting state, the support block 210 is swung relative to the transferring seat 215 until the length direction of the support block 210 (i.e., the direction perpendicular to the paper surface as shown in FIG. 25) is parallel to the width direction of the standby material strip B2, so that the standby material strip B2 is wound onto and passed through the support block 210. When the support block 210 is rotated to the avoidance position, the support block 210 is swung relative to the transferring seat 215 until the length direction of the support block 210 intersects with the width direction of the standby material strip B2, i.e., the length direction of the support block 210 intersects with the axis of each guide passing-roller 229. Therefore, the support block 210 does not collide with each guide passing-roller 229 and the tape material strip E, and thus enables the standby material strip B2 to be pulled out smoothly when the mounting seat 221 is swinging. Preferably, when the support block 210 is rotated to the avoidance position, the length direction of the support block 210 is perpendicular to the width direction of the standby material strip B2.

Optionally, the support mechanism 21 further comprises a third movement actuator 216, a rack 217 and a gear 218. The third movement actuator 216 is mounted on the transferring seat 215, and the rack 217 is mounted on a driving end of the third movement actuator 216. The gear 218 is mounted on the support block 210 and engages with the rack 217. The third movement actuator 216 is configured to drive the rack 217 to move, enabling the rack 217 to drive the support block 210 to swing with the gear 218. In this way, the engagement of the gear 218 and the rack 217 is used for driving, and the linear motion outputted by the third movement actuator 216 is converted into a swing motion of the support block 210 relative to the transferring seat 215. The structure is simple, the driving is stable and reliable, requiring occupation of a small space. Optionally, the third movement actuator 216 may be a cylinder.

The technical features of the above-described embodiments can be combined in any manner. For the sake of brevity of description, not all possible combinations of the individual technical features of the above-described embodiments have been described; however, as long as there is no contradiction between the combinations of these technical features, they should be considered to be within the scope of the present specification.

The above-described embodiments are merely illustrations of a few implementations of the present application described in a specific and detailed manner, and are not to be construed as limitation to the scope of the patent. It should be noted that for a person of ordinary skill in the art, variations and improvements could be made without departing from the principle of the present application, and these fall within the protection scope of the present application. Therefore, the scope of protection of the present application shall be defined by the appended claims.

The invention claimed is:

1. An automatic roll-replacing apparatus, comprising:

an unwinding device for loading a working material roll and a standby material roll and for driving the working material roll to unwind and output a working material strip;

a starting-end-handling device comprising a support mechanism and a pick-up mechanism, the support mechanism located between the standby material roll and the working material roll; the pick-up mechanism configured to pick up a material strip starting end of a standby material strip, and pull the material strip starting end to reach a location between the support mechanism and the working material roll, so that the standby material strip is wound onto and passed through the support mechanism; and a strip-connecting device comprising first and second strip-connecting mechanisms; wherein the first strip-connecting mechanism carries a tape and is configured to press a first portion of the tape and the standby material strip against one side of the support mechanism; wherein the second strip-connecting mechanism is configured to press the working material strip against an opposite side of the support mechanism, cut off the working material strip from an upstream side of the support mechanism, and press the working material strip against a second portion of the tape on a downstream side of the support mechanism.

2. The automatic roll-replacing apparatus according to claim 1, wherein, the support mechanism is adapted to be controlled to move between an avoidance position and a strip-connecting position in a first direction, the unwinding device comprises two unwinding mechanisms spaced along a second direction intersecting the first direction, two material rolls loaded on the two unwinding mechanisms are used alternately as the working material roll and the standby material roll respectively; and the pick-up mechanism is adapted to be controlled to move between the two unwinding mechanisms to pull the material strip starting end through between the avoidance position and the strip-connecting position, so that the standby material strip is wound onto and passed through the support mechanism when the support mechanism is moving from the avoidance position to the strip-connecting position.

3. The automatic roll-replacing apparatus according to claim 2, wherein, the support mechanism further comprises a support block adapted to move in a controlled way along the first direction, the support block has a first adsorption surface on each of the two sides thereof in the second direction, and the first adsorption surface is configured to adsorb the standby material strip.

4. The automatic roll-replacing apparatus according to claim 3, wherein, the support mechanism further comprises a first support roller rotatably provided on the support block, the first support roller is located on one side of the support block facing towards the avoidance position; the first and second strip-connecting mechanisms each has an abutting roller which is rotatable;

in the strip-connecting position, the abutting roller of the first strip-connecting mechanism is configured to press the standby material strip against the first support roller, and the abutting roller of the second strip-connecting mechanism is configured to press the working material strip against the first support roller.

5. The automatic roll-replacing apparatus according to claim 3, wherein, the support mechanism further comprises a second support roller rotatably provided on the support block, the second support roller is located on one side of the support block facing towards the strip-connecting position and for the standby material strip to be wound onto and passed through.

6. The automatic roll-replacing apparatus according to claim 2, wherein, the starting-end-handling device further comprises a first swing mechanism which is in driving connection with the pick-up mechanism, and the first swing mechanism is configured to drive the pick-up mechanism to swing between the two unwinding mechanisms.

7. The automatic roll-replacing apparatus according to claim 1, wherein, the strip-connecting device further comprises two second swing mechanisms in one-to-one correspondence to the first and second strip-connecting mechanisms, each of the second swing mechanisms is in driving connection with the corresponding first and second strip-connecting mechanisms to drive the corresponding first and second strip-connecting mechanisms to swing in a direction close to or away from the support mechanism.

8. The automatic roll-replacing apparatus according to claim 1, wherein, the pick-up mechanism comprises a mounting seat and a gripping assembly provided on the mounting seat, the gripping assembly having a first gripping member and a second gripping member disposed opposite each other; a gripping space is formed between the first gripping member and the second gripping member for gripping the material strip starting end on the standby material roll, and at least one of the first gripping member and the second gripping member are adapted to get close to or far away from the other, wherein the mounting seat is adapted to be controlled to drive the gripping assembly to move to the standby material roll to grip the material strip starting end, and drive the gripping assembly to move so as to pull the standby material strip to be wound onto and passed through the support mechanism.

9. The automatic roll-replacing apparatus according to claim 8, wherein, the first gripping member has a second adsorption surface on one side thereof facing the second gripping member, and the second gripping member has a blowing surface on one side thereof facing the first gripping member;

when the mounting seat drives the gripping assembly to move to the standby material roll, the blowing surface blows an edge portion of the material strip starting end towards the second adsorption surface and the edge portion is adsorbed by the second adsorption surface.

10. The automatic roll-replacing apparatus according to claim 1, wherein, the pick-up mechanism comprises:

a mounting seat adapted to be controlled to move close to or away from the standby material roll;

a sticking assembly comprising a tape-unwinding structure, a tape-winding structure and a sticking member all provided on the mounting seat; the tape-unwinding structure is configured to output a tape material strip to the sticking member so as to wind the tape material strip through the sticking member, and one side of the tape material strip facing away from the sticking member is an adhesive side; the tape-winding structure is configured to wind the tape material strip having been wound onto and passed through the sticking member;

wherein, when the mounting seat is moving close to the standby material roll, the mounting seat is adapted to drive the sticking member to be pressed against the standby material roll, so that the tape material strip on the sticking member sticks to the material strip starting end of the standby material roll.

11. The automatic roll-replacing apparatus according to claim 10, wherein, the sticking member is a sticking roller connected to the mounting seat in a way that the sticking roller is rotatable about its own axis.

12. The automatic roll-replacing apparatus according to claim 11, wherein, when the mounting seat drives the sticking roller to be pressed against the standby material roll, the tape-winding structure winds the tape material strip and drives the sticking roller to rotate, the standby material roll rotates to unwind the standby material strip, and the sticking roller rotates in a direction opposite to a rotating direction of the standby material roll.

13. The automatic roll-replacing apparatus according to claim 10, wherein, the support mechanism has an avoidance state and a strip-connecting state;

when the support mechanism is in the avoidance state, the support mechanism provides collision avoidance for movement of the sticking member driven away from the standby material roll by the mounting seat;

when the support mechanism is in the strip-connecting state, the support mechanism is configured to be wound onto and passed through by the standby material strip pulled out by the tape material strip on the sticking member.

14. The automatic roll-replacing apparatus according to claim 13, wherein, the support mechanism comprises a transferring seat and a support block, one end of the support block is rotatably connected to the transferring seat;

wherein, when the support mechanism is in the strip-connecting state, the support block is swung relative to the transferring seat until a length direction of the support block is parallel to a width direction of the standby material strip; and when the support mechanism is in the avoidance state, the support block is swung relative to the transferring seat until the length direction of the support block intersects the width direction of the standby material strip.

15. The automatic roll-replacing apparatus according to claim 1, wherein the first and second strip-connecting mechanisms each has a first abutting portion and a second abutting portion that carry the tape together;

when the first strip-connecting mechanism moves to a strip-connecting position, it presses the tape and the standby material strip against one side of the support mechanism with the first abutting portion of itself;

when the second strip-connecting mechanism moves to the strip-connecting position, it presses the working material strip against the other side of the support mechanism with the first abutting portion of itself, and also presses the working material strip against the first strip-connecting mechanism with the second abutting portion of itself from the downstream side of the support mechanism, until the second strip-connecting mechanism is pressed against the second abutting portion of the first strip-connecting mechanism.

16. The automatic roll-replacing apparatus according to claim 15, wherein the first and second strip-connecting mechanisms each further comprises a cutting member for cutting off the working material strip, the cutting member is located on one side of the first abutting portion facing away from the second abutting portion.

17. The automatic roll-replacing apparatus according to claim 15, wherein the first and second strip-connecting mechanisms are each adapted to be controlled to move between a respective tape preparation position and the strip-connecting position;

the strip-connecting device further comprises a tape preparation mechanism, the tape preparation mechanism comprising a moving seat and a tape supply assembly provided on the moving seat, the tape supply assembly has a tape supplying sucker for adsorbing the tape, the tape supplying sucker is adapted to move in a controlled way in a first predetermined direction;

the moving seat is adapted to move in a controlled way to the tape preparation position of each of the first and second strip-connecting mechanisms; when the moving seat is moved to the tape preparation position of either of the first and second strip-connecting mechanisms, the tape supplying sucker is disposed opposite to the first and the second abutting portions of its corresponding first and second strip-connecting mechanisms in the first predetermined direction.

18. The automatic roll-replacing apparatus according to claim 17, wherein, the strip-connecting device further comprises a cylinder conveying mechanism and a cylinder collecting mechanism, the cylinder conveying mechanism is mounted on the moving seat and the cylinder collecting mechanism is arranged in a first position; the unwinding device comprises two unwinding mechanisms respectively arranged in a second position and a third position;

the moving seat is adapted to be controlled to move between the first position, the second position and the third position; when the moving seat moves to the second position or the third position, the cylinder conveying mechanism grips an empty cylinder on a corresponding unwinding mechanism; when the moving seat moves to the first position, the cylinder conveying mechanism transfers the gripped empty cylinder to the cylinder collecting mechanism.

19. The automatic roll-replacing apparatus according to claim 1, wherein, the unwinding device comprises two unwinding mechanisms, the automatic roll-replacing apparatus further comprising a guide device for guiding the working material strip unwound and output by either of the two unwinding mechanisms;

each of the unwinding mechanisms comprising an aligning assembly and an unwinding assembly mounted at one driving end of the aligning assembly, the unwinding assembly has an unwinding shaft for loading the working material roll or the standby material roll, and the aligning assembly is configured to drive the unwinding assembly to move axially along the unwinding shaft;

the guide device comprises a fixed seat, a guide frame, a guide roller and a switching mechanism; the guide frame is movably connected to the fixed seat in a direction parallel to an axial direction of the unwinding shaft, the guide roller is mounted on the guide frame, and the switching mechanism is connected to the guide frame and is selectively connected to either of the unwinding assemblies of the two unwinding mechanisms.

20. The automatic roll-replacing apparatus according to claim 1, wherein, the unwinding device comprises two unwinding mechanisms, each of the unwinding mechanisms comprises an unwinding assembly and a material-prodding assembly, the unwinding assembly comprises a carrier seat, a carrier shaft and an unwinding shaft;

the carrier shaft is mounted on the carrier seat, the unwinding shaft is coaxially provided on the carrier shaft and has a mounting section and an unwinding section, the unwinding shaft is rotatable about its own axis and axially movable relative to the carrier shaft, and the unwinding shaft is able to drive the unwinding section to axially dock with the carrier shaft or separate from the carrier shaft during its axial movement relative to the carrier shaft;

wherein the carrier shaft is configured to carry one or more standby material rolls, and the material-prodding assembly is configured to prod the standby material roll on the carrier shaft toward the unwinding section.

* * * * *